US011592162B2

(12) United States Patent
Bazzechi et al.

(10) Patent No.: US 11,592,162 B2
(45) Date of Patent: Feb. 28, 2023

(54) LED LUMINAIRE

(71) Applicant: IDEAL INDUSTRIES LIGHTING LLC, Durham, NC (US)

(72) Inventors: Emanuele Bazzechi, Selva Val Gardena (IT); Alessandro Fortini, Pistoia (IT)

(73) Assignee: IDEAL Industries Lighting LLC, Durham, NC (US)

( * ) Notice: Subject to any disclaimer, the term of this patent is extended or adjusted under 35 U.S.C. 154(b) by 0 days.

(21) Appl. No.: 17/091,385

(22) Filed: Nov. 6, 2020

(65) Prior Publication Data

US 2021/0190299 A1 Jun. 24, 2021

(30) Foreign Application Priority Data

Dec. 23, 2019 (IT) ..... 102019000025216

(51) Int. Cl.
*F21V 17/10* (2006.01)
*F21V 15/01* (2006.01)
(Continued)

(52) U.S. Cl.
CPC ..... *F21V 17/107* (2013.01); *F21V 15/01* (2013.01); *F21V 17/104* (2013.01); *F21V 31/005* (2013.01); *F21S 8/088* (2013.01)

(58) Field of Classification Search
CPC ..... F21V 17/107; F21V 17/104; F21V 17/18; F21V 15/01; F21V 15/012; F21V 15/013;
(Continued)

(56) References Cited

U.S. PATENT DOCUMENTS 3,295,714 A * 1/1967 Di Addario ..... E05D 7/1077 220/840
3,666,134 A * 5/1972 Rauch ..... E05B 65/006 220/324
(Continued)

FOREIGN PATENT DOCUMENTS

CN 201416854 Y * 3/2010
CN 103307524 A * 9/2013
(Continued)

OTHER PUBLICATIONS

Cheng, Connecting Structure for Lamp Body and Lamppost, Nov. 3, 2016, WO2016172924A1 (Year: 2016).*
(Continued)

*Primary Examiner* — Jong-Suk (James) Lee
*Assistant Examiner* — James M Endo
(74) *Attorney, Agent, or Firm* — Withrow & Terranova, P.L.L.C.

(57) ABSTRACT

A luminaire has a first housing portion and a second housing portion formed of a polymeric material. A hinge pivotably connects the first housing portion to the second housing portion and includes a pintle formed as one-piece with one of the first and second housing portions and a knuckle formed as one-piece with the other one of the first and second housing portions. A sealing structure seals a compartment formed between the first housing portion and the second housing portion. The sealing structure includes a channel supported by one of the first and second housing portions and a frame supported in the channel. The frame supports a deformable gasket. A sealing member extends from the other one of the first and second housing portions where the sealing member extends into the channel and engages the gasket. A locking feature secures the first housing portion to the second housing portion.

19 Claims, 25 Drawing Sheets

(51) Int. Cl.
*F21V 31/00* (2006.01)
*F21S 8/08* (2006.01)

(58) Field of Classification Search
CPC . F21V 31/005; F21S 8/08; F21S 8/085; F21S 8/086; F21S 8/088; Y02B 20/72; F16B 37/16
See application file for complete search history.

(56) References Cited

U.S. PATENT DOCUMENTS 4,298,204 A * 11/1981 Jinkins ..... F16J 15/062 277/641
4,419,029 A * 12/1983 Wenzel ..... F16B 37/16 403/11
4,443,831 A * 4/1984 Godfrey ..... B60Q 3/51 362/135
4,796,001 A * 1/1989 Gostyla ..... F21V 23/026 338/20
5,136,493 A * 8/1992 Straus ..... F21V 29/15 362/373
5,366,317 A * 11/1994 Solimar ..... B65D 90/10 220/325
5,529,205 A * 6/1996 Corney ..... B65D 43/164 220/832
5,803,590 A * 9/1998 Wedell ..... F21V 17/18 362/649
6,461,026 B1 * 10/2002 Wang ..... F21V 17/107 16/267
6,749,237 B1 * 6/2004 Ma ..... B66C 1/66 294/180
7,175,313 B2 * 2/2007 Bednara ..... H05K 5/0221 220/315
8,471,145 B2 * 6/2013 Suzuki ..... H05K 5/0226 174/50
8,770,797 B2 * 7/2014 Wang ..... F21V 29/74 362/294
9,303,823 B2 4/2016 Hu et al.
9,435,519 B2 * 9/2016 Kinnune ..... F21V 21/0832
9,791,110 B2 10/2017 Hu et al.
9,835,317 B2 12/2017 Tuan et al.
10,278,250 B2 4/2019 McBryde et al.
2008/0002399 A1 * 1/2008 Villard ..... F21S 8/086 362/184
2008/0068799 A1 * 3/2008 Chan ..... F21V 29/763 361/697
2010/0073939 A1 * 3/2010 Kauffman ..... F21V 21/116 362/341
2011/0013397 A1 * 1/2011 Catone ..... F21V 5/007 362/244
2011/0038153 A1 * 2/2011 Hu ..... F21V 29/76 362/249.02
2011/0211356 A1 * 9/2011 Blincoe ..... F21V 17/12 362/396
2011/0305027 A1 * 12/2011 Ham ..... F21V 31/005 362/368
2012/0162980 A1 * 6/2012 Mrakovich ..... F21V 15/01 362/235
2012/0243229 A1 * 9/2012 Cheng ..... F21S 8/028 362/249.02
2012/0287668 A1 * 11/2012 Richardson ..... G02B 6/0048 362/602
2013/0188371 A1 * 7/2013 Ham ..... F21V 23/0442 362/373
2013/0223065 A1 * 8/2013 Hsieh ..... F21V 23/02 362/235
2013/0292383 A1 * 11/2013 Mullaney ..... H05K 5/062 220/378
2014/0355259 A1 * 12/2014 Ku ..... F21V 15/01 362/183
2015/0040407 A1 * 2/2015 Lin ..... A01G 3/02 30/312
2015/0260362 A1 * 9/2015 Koga ..... H05B 45/00 362/362
2016/0187555 A1 * 6/2016 Yuan ..... G02B 6/002 362/343
2017/0031085 A1 * 2/2017 Lim ..... G02B 6/32
2018/0238505 A1 * 8/2018 Cartmill ..... F21K 9/69

FOREIGN PATENT DOCUMENTS

EP 3163153 A1 5/2017
WO 2015063807 A1 5/2015
WO 2016016838 A1 2/2016
WO WO-2016172924 A1 * 11/2016 ..... F21V 21/30

OTHER PUBLICATIONS

Li, LED (Light Emitting Diode) street lamp with adjustable mounting angle, Sep. 18, 2013, CN103307524A (Year: 2013).*
Shiyou, Street lamp tail installation tube, Mar. 3, 2010, CN201416854Y (Year: 2010).*
Italian Search Report corresponding to Italian Patent Application No. 102019000025216 (14 pages) (dated Aug. 24, 2020).
Invitation to Pay Additional Fees and Partial Search for International Patent Application No. PCT/US2020/059263, dated Jan. 26, 2021, 14 pages.

* cited by examiner

LED LUMINAIRE

CROSS-REFERENCE TO RELATED APPLICATION

The present application claims priority to Italian Patent Application No. 102019000025216, filed Dec. 23, 2019, the entire content of which is incorporated herein by reference as if set forth fully herein.

BACKGROUND OF THE INVENTION

An LED luminaire typically includes a plurality of LEDs that serve as a light source, an LED driver circuit to regulate voltage and current that reaches the LEDs, a heat exchanger to transfer heat generated by the LEDs, and a luminaire housing. The luminaire may further include an optical waveguide that controls the distribution of light. The luminaire may be mounted on a stanchion or pole to provide a luminaire suitable for use in outdoor applications such as street lights, parking lot lights or the like. Such luminaires may produce a high luminous flux and may produce significant heat. A durable luminaire that efficiently produces a high luminous flux is desirable in many applications.

SUMMARY OF THE INVENTION

In some embodiments, a luminaire includes a housing comprising a first housing portion formed of a polymeric or plastic material and a second housing portion formed of a polymeric or plastic material. A LED light source is at least partially contained in the housing. A hinge pivotably connects the first housing portion to the second housing portion to allow access to the interior of the housing. The hinge comprises at least one pintle formed as one-piece with one of the first housing portion and the second housing portion and at least one knuckle formed as one-piece with the other one of the first housing portion and the second housing portion such that the housing portion with the at least one knuckle is formed unitarily and the housing portion with the at least one pintle is formed unitarily. The at least one pintle is rotatably received in the at least one knuckle.

The at least one pintle may comprise a plurality of spaced pintles and the at least one knuckle may comprise a plurality of spaced knuckles, wherein each of the plurality of spaced pintles is received in one of the plurality of spaced knuckles. The at least one pintle may comprise an external surface that is formed by a pair of curved surfaces that define the rotational support surface of the at least one pintle, the pair of curved surfaces being connected by flat surfaces. The at least one knuckle may comprise a sleeve that rotatably receives the at least one pintle and an opening in the sleeve that communicates an interior of the knuckle with an exterior of the knuckle. The opening may be dimensioned such that it has a width that is approximately equal to or slightly greater than the distance between the flat surfaces of the at least one pintle. The at least one pintle may be inserted through the opening. The first housing portion and the second housing portion may define a compartment where a sealing structure is formed between the first housing portion and the second housing portion to seal the compartment. The sealing structure may comprise a channel supported by one of the first housing portion and the second housing portion where the channel extends about a periphery of the compartment. The channel may be formed at the distal end of a wall extending from the one of the first housing portion and the second housing portion. The sealing structure may comprise a deformable gasket in the channel. The deformable gasket may comprise a form-in-place soft foam. The sealing structure may comprise a frame supported in the channel where the frame defines a sealing surface. The sealing structure may comprise a deformable gasket supported by the sealing surface. The sealing structure may comprise a sealing member extending from the other one of the first housing portion and the second housing portion where the sealing member extends into the channel and engages the gasket. A locking feature may secure the first housing portion to the second housing portion. The locking feature may comprise a fastener that engages one of the first housing portion and the second housing portion and that is threadably engageable with a mating connector supported by the other one of the first housing portion and the second housing portion. The one of the first housing portion and the second housing portion may comprise at least one pair of spaced projections and the fastener may comprise a locking member movable between a first position where the locking member is secured by the at least one pair of spaced projections and a second position where the locking member is not secured by the at least one pair of spaced projections. The mating connector may comprise a threaded fitting.

In some embodiments, a luminaire comprises a first housing portion formed of plastic material and a second housing portion formed of a polymeric/plastic material. The first housing portion and the second housing portion define a compartment. A sealing structure is formed between the first housing portion and the second housing portion to seal the compartment. The sealing structure comprises a channel supported by one of the first housing portion and the second housing portion where the channel extends about a periphery of the compartment. A frame is supported in the channel that defines a sealing surface. The sealing surface supports a deformable gasket. A sealing member extends from the other one of the first housing portion and the second housing portion and extends into the channel and engages the gasket.

The deformable gasket may comprise a form-in-place soft foam. The frame may be press fit in the channel.

DETAILED DESCRIPTION OF EMBODIMENTS OF THE INVENTION

Figure 1:
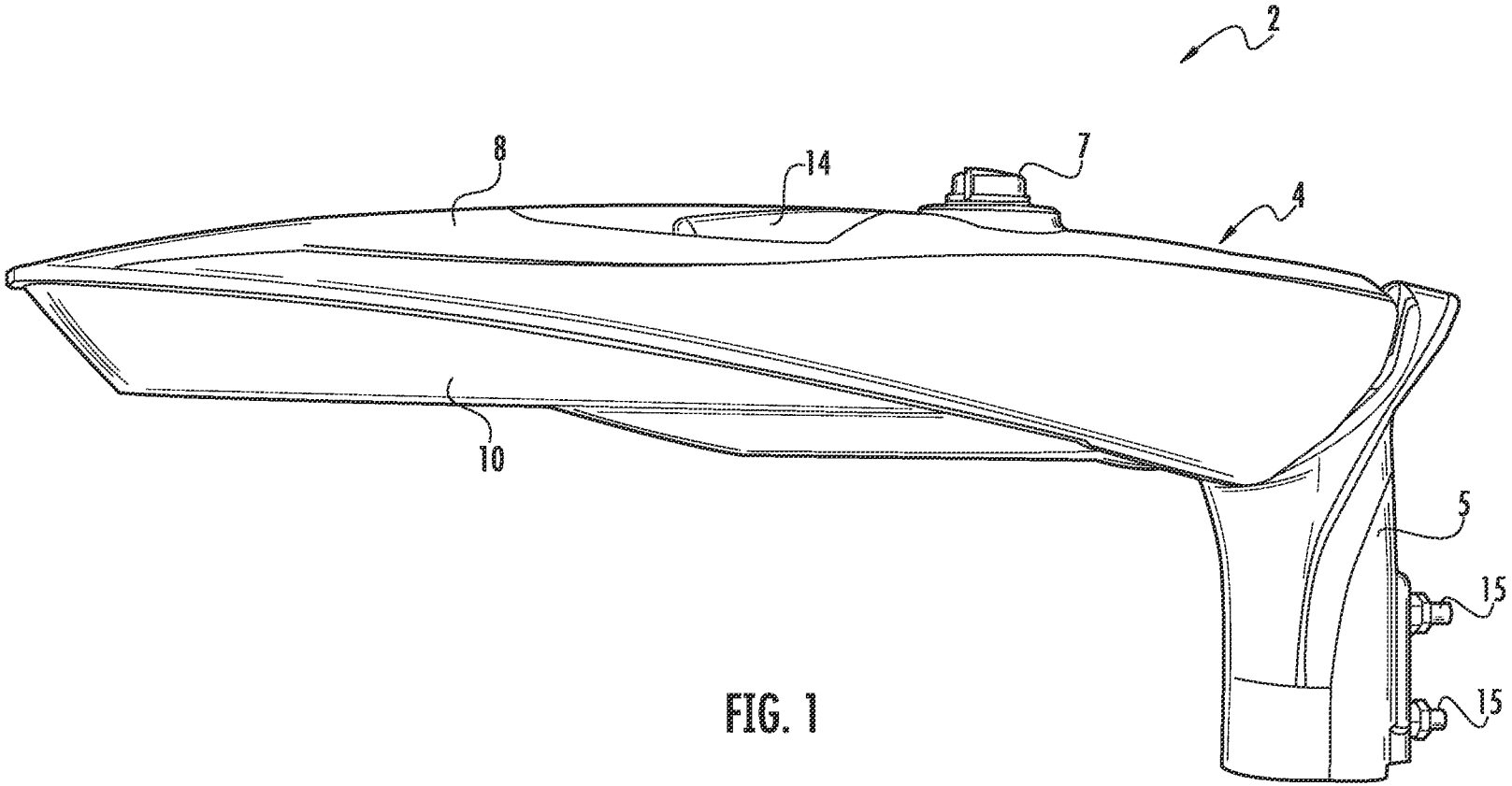
FIG. 1 is a side view of a luminaire according to embodiments of the invention.
Figure 2:
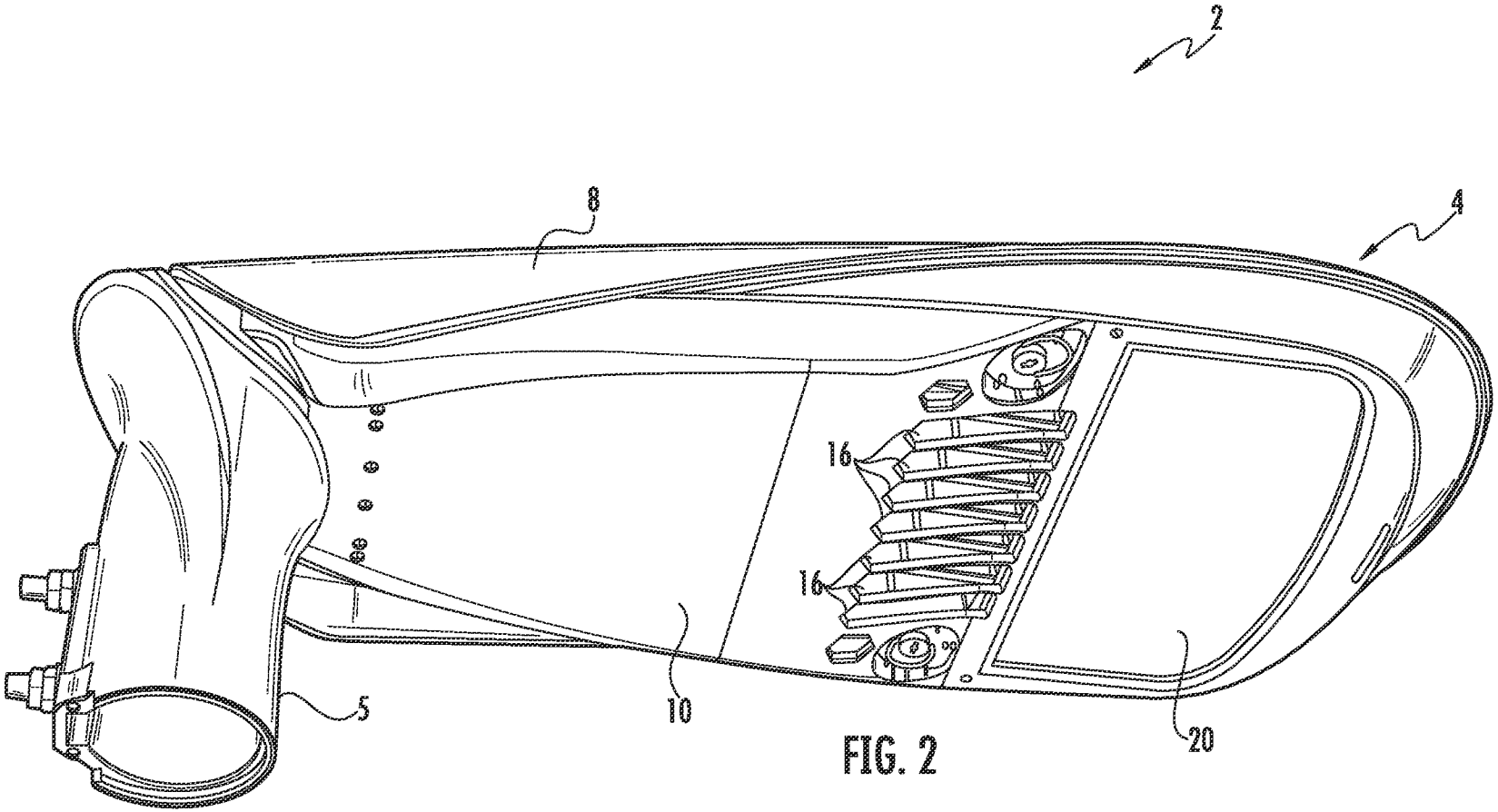
FIG. 2 is a perspective bottom view of the luminaire of FIG. 1.
Figure 3:
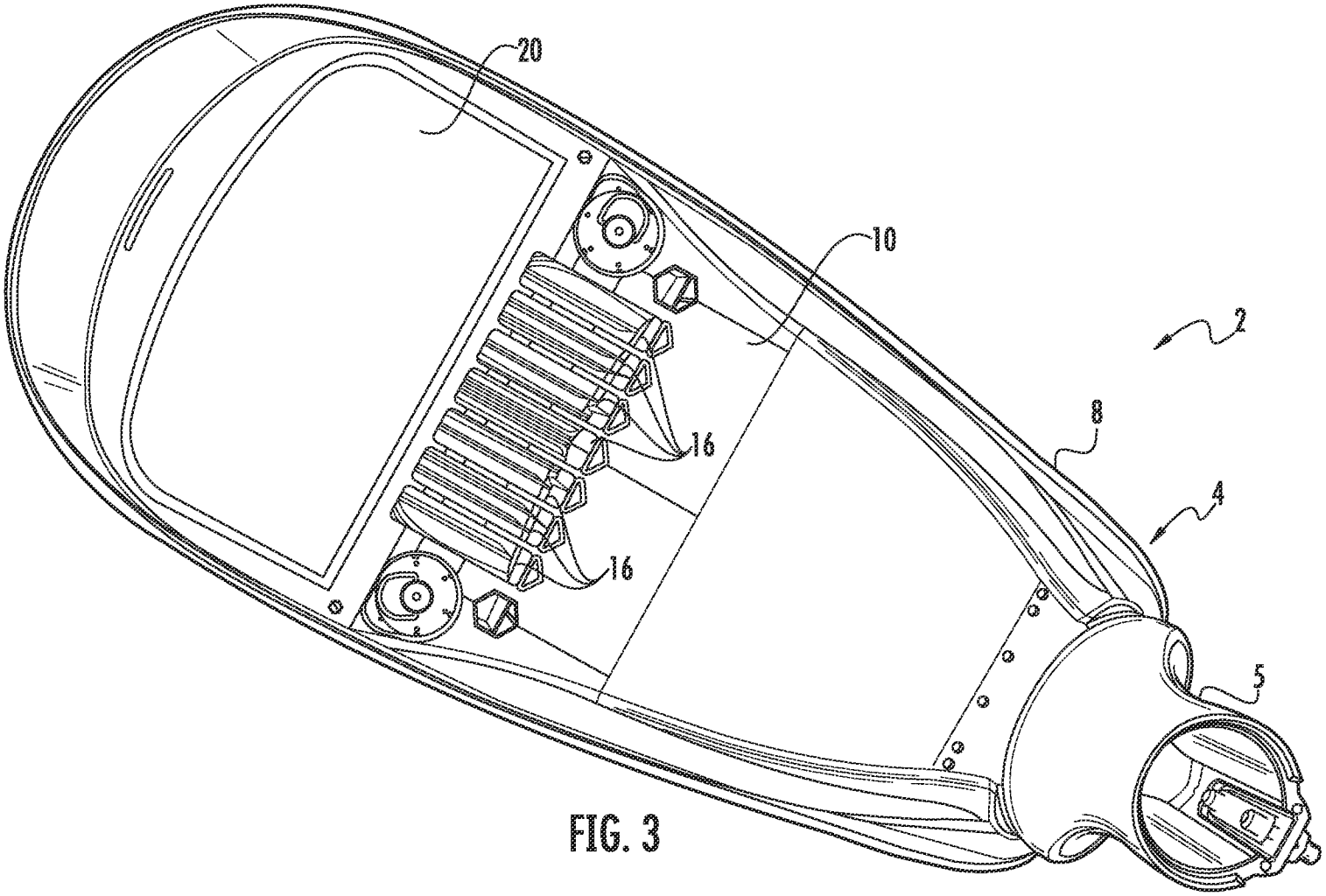
FIG. 3 is a bottom view of the luminaire fixture of FIG. 1.
Figure 4A:
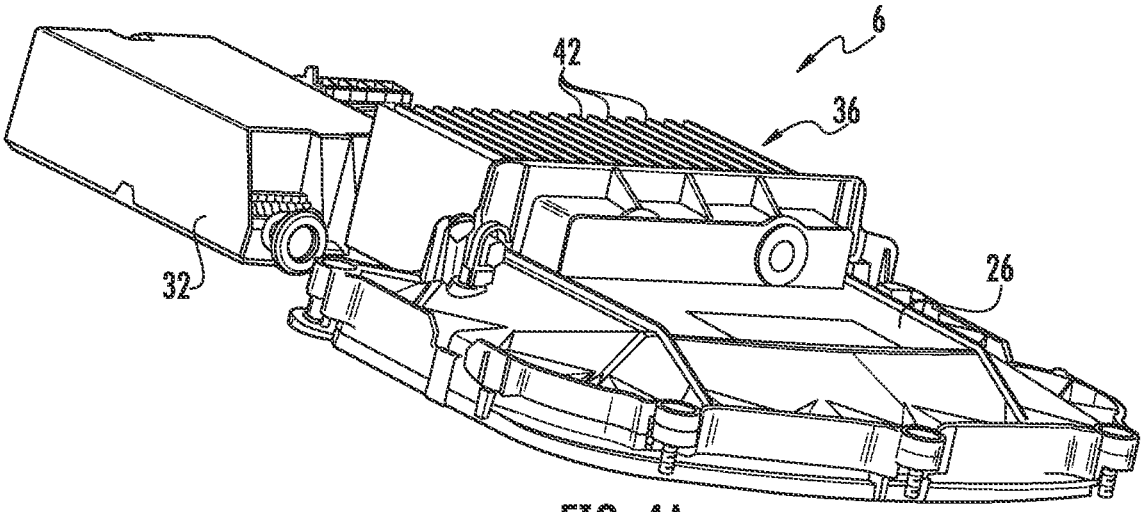
FIG. 4A-4C are perspective views of an embodiment of a lighting assembly usable in the luminaire of FIG. 1.
Figure 4B:
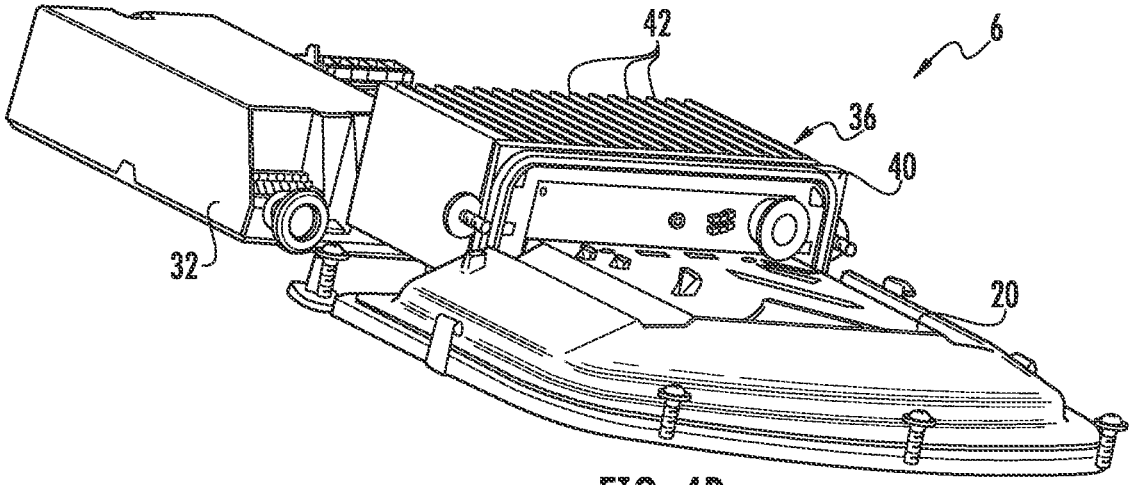
Figure 4C:
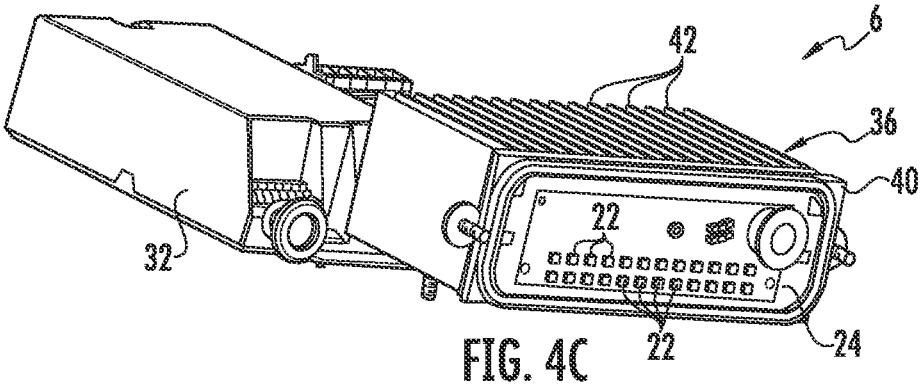

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

As shown in FIGS. 1 through 12, the luminaire 2 comprises a luminaire housing 4 and a light emitting assembly 6. In general, the luminaire 2 is capable of being mounted on a support such as a stanchion or pole 3 using stanchion bracket 5. The luminaire housing 4 comprises a top housing portion 8 and a bottom housing portion 10. A light sensor 7 may be secured to the housing 4 and may communicate with the interior of the housing 2 via aperture 12. Upper convection openings 14 are disposed in the top housing portion 8. While two convection openings 14 are shown, a greater or fewer number of convection openings may be provided. The bottom housing portion 10 comprises lower convection openings 16 disposed generally below the upper convection openings 14. As described above with respect to upper convection openings 14, a greater or fewer number of lower convection openings 16 may be provided.

The light emitting assembly 6 is at least partially enclosed by the luminaire housing 4 and comprises an optical waveguide 20 for emitting light in a desired pattern. The optical waveguide 20 is positioned in opening 21 in bottom housing portion 10 to emit light from luminaire 2. A plurality of LEDs 22 are disposed adjacent a light input edge of the optical waveguide 20. The LEDs 22 may be mounted on LED board 24 which may form part of the electrical path from the power supply to the LEDs. An upper frame member 26 may partially surround the optical waveguide 20 and form a barrier between the optical waveguide 20 and the luminaire housing 4. A reflective bottom surface of the upper frame member 26 may be disposed adjacent one or more upper surfaces of the optical waveguide 20. The light emitting assembly 6 further comprises an LED driver for providing critical current to the LEDs 22 which may be contained in a driver housing 32. Suitable electrical connectors, such as wires, (not shown) may extend from the LED driver through a membrane gasket in driver housing 32 to the LED board 24 through a membrane gasket in upper frame member 26. Any of the embodiments disclosed herein incorporating LED light sources may include power or driver circuitry having a buck regulator, a boost regulator, a buck-boost regulator, a fly-back converter, a SEPIC power supply or the like and/or multiple stage power converter employing the like, and may comprise a driver circuit as disclosed in U.S. Pat. No. 9,791,110, issued Oct. 17, 2017, entitled "High Efficiency Driver Circuit with Fast Response" by Hu et al. or U.S. Pat. No. 9,303,823, issued Apr. 5, 2016, entitled "SEPIC Driver Circuit with Low Input Current Ripple" by Hu et al. both of which are incorporated by reference herein in their entirety. The circuit may further be used with light control circuitry that controls color temperature of any of the embodiments disclosed herein, such as disclosed in U.S. Pat. No. 10,278,250, issued Apr. 30, 2019, entitled "Lighting Fixture Providing Variable CCT" by Pope et al. which is incorporated by reference herein in its entirety. Further details of the optical waveguide are disclosed in U.S. Pat. No. 9,835,317, issued Dec. 5, 2017, entitled "Luminaire Utilizing Waveguide" by Yuan et al., the disclosure of which is hereby incorporated by reference herein in its entirety.

A heat exchanger 36 is provided to cool the components of the light emitting assembly 6. The heat exchanger 36 comprises a base plate 40 and a plurality of fins 42 in thermal communication with the base plate 40. The fins 42 are disposed in a plane that is preferably substantially or fully transverse (and more preferably, normal) to the bottom surface of the luminaire 2 and substantially or fully transverse (and more preferably, normal) to the base plate 40. The LED board 24 may comprise a conductive printed circuit board (PCB) that receives and mounts the LEDs 22 and conducts heat therefrom. The LED board 24 is preferably made of one or more materials that efficiently conduct heat and is disposed in thermal communication with the base plate 40 of the heat exchanger 36. In the illustrated embodiment, the LEDs 22 are in contact with a front surface of the LED board 24 and a back surface of the LED board 24 is in contact with the base plate 40. Heat is transferred from the LED driver circuit 30 and the LEDs 22 to the fins 42 that, in turn, transfer heat at least by convection through the upper convection openings 14 and lower convection openings 16. In the illustrated embodiments, upper convection openings 14 and lower convection openings 16 are disposed above and below, respectively, the fins 42 (when the luminaire 2 is mounted in a typical orientation with the waveguide 20 facing generally downward) to provide for efficient heat transfer via a direct vertical path of convection flow.

Figure 5:
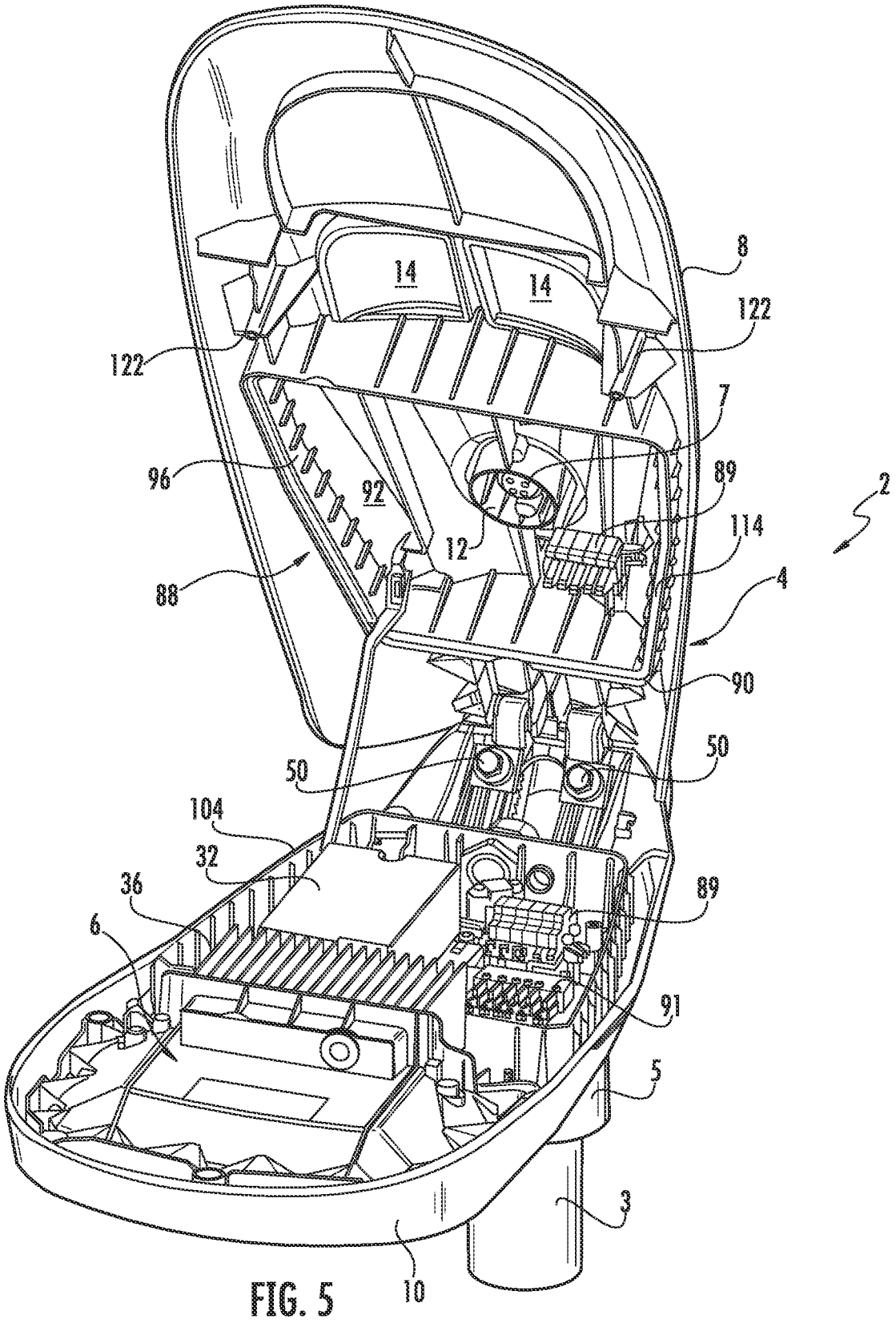
FIG. 5 is a perspective view of the luminaire of FIG. 1 in an open position.
Figure 6:
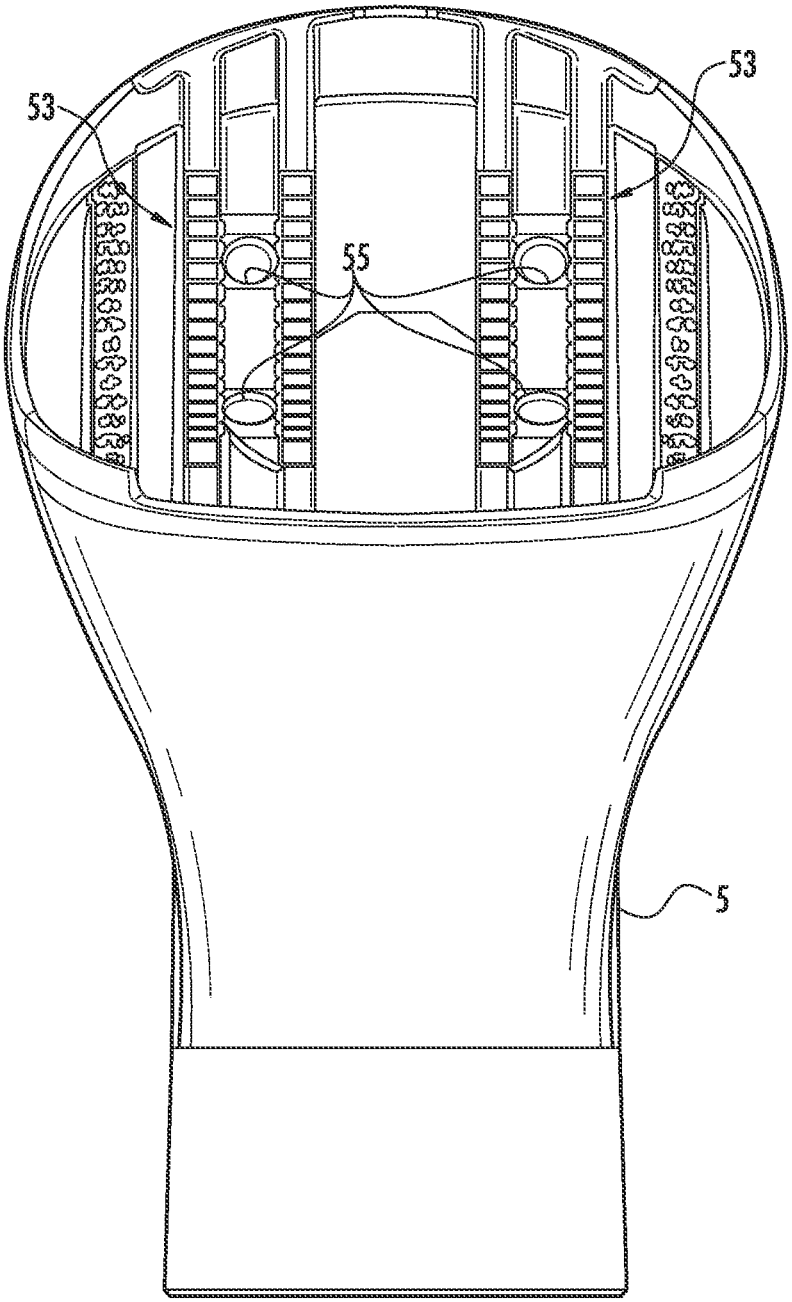
FIG. 6 is a front view of a stanchion bracket used with the luminaire of FIG. 1.
Figure 7:
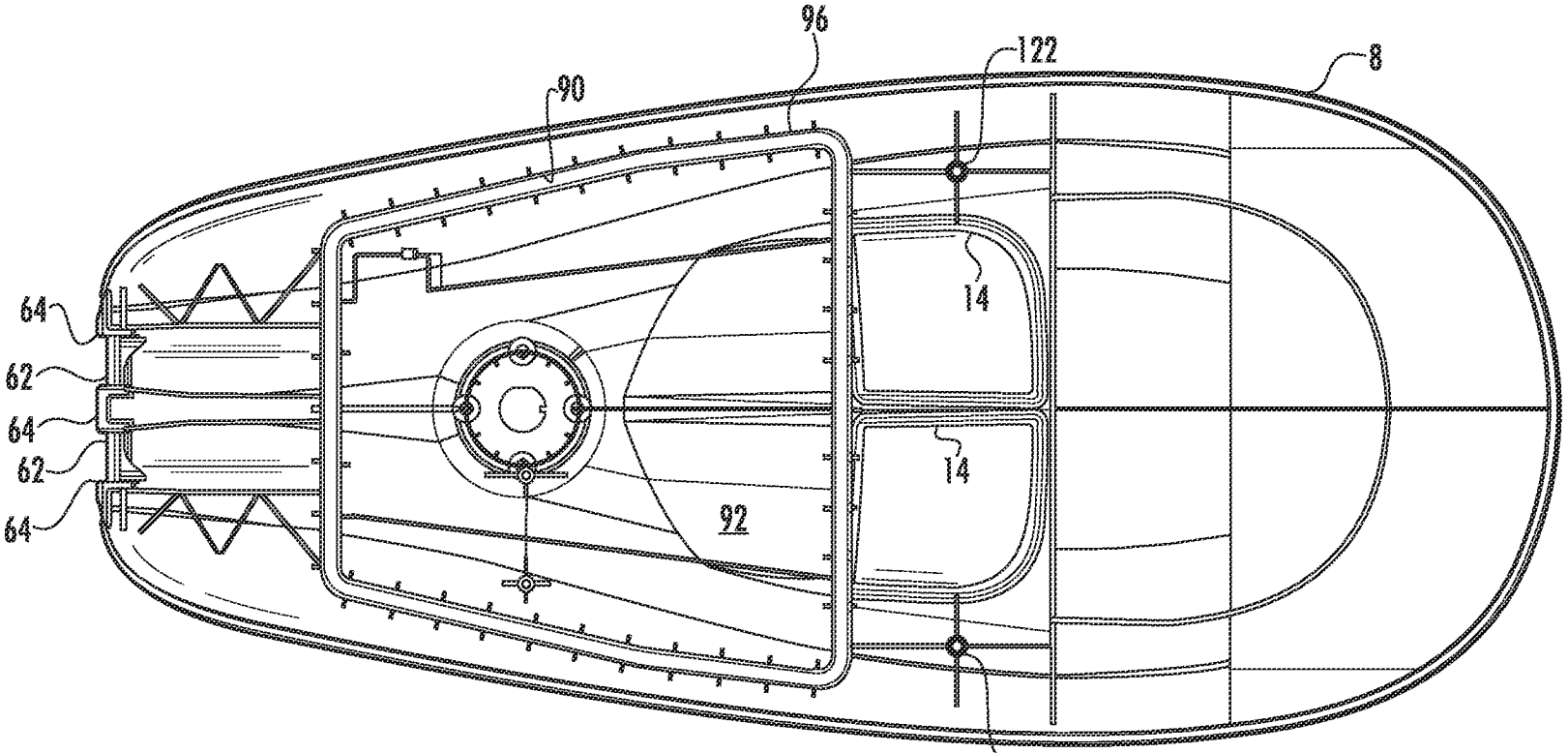
FIG. 7 is a view of the interior of the top housing portion of the luminaire of FIG. 1.
Figure 8:
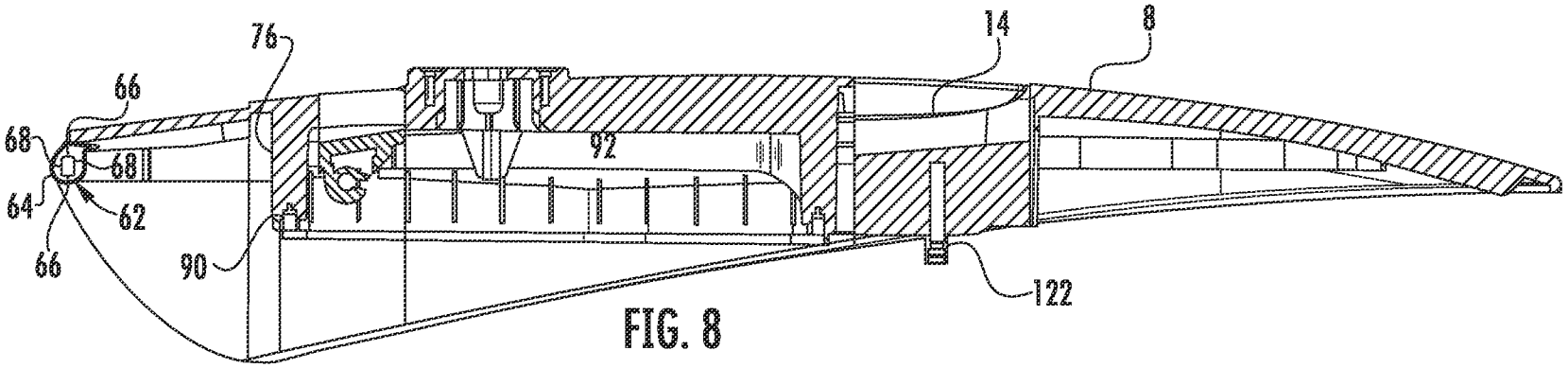
FIG. 8 is a section view of the top housing portion of the luminaire of FIG. 1 taken along a longitudinal centerline.
Figure 9:
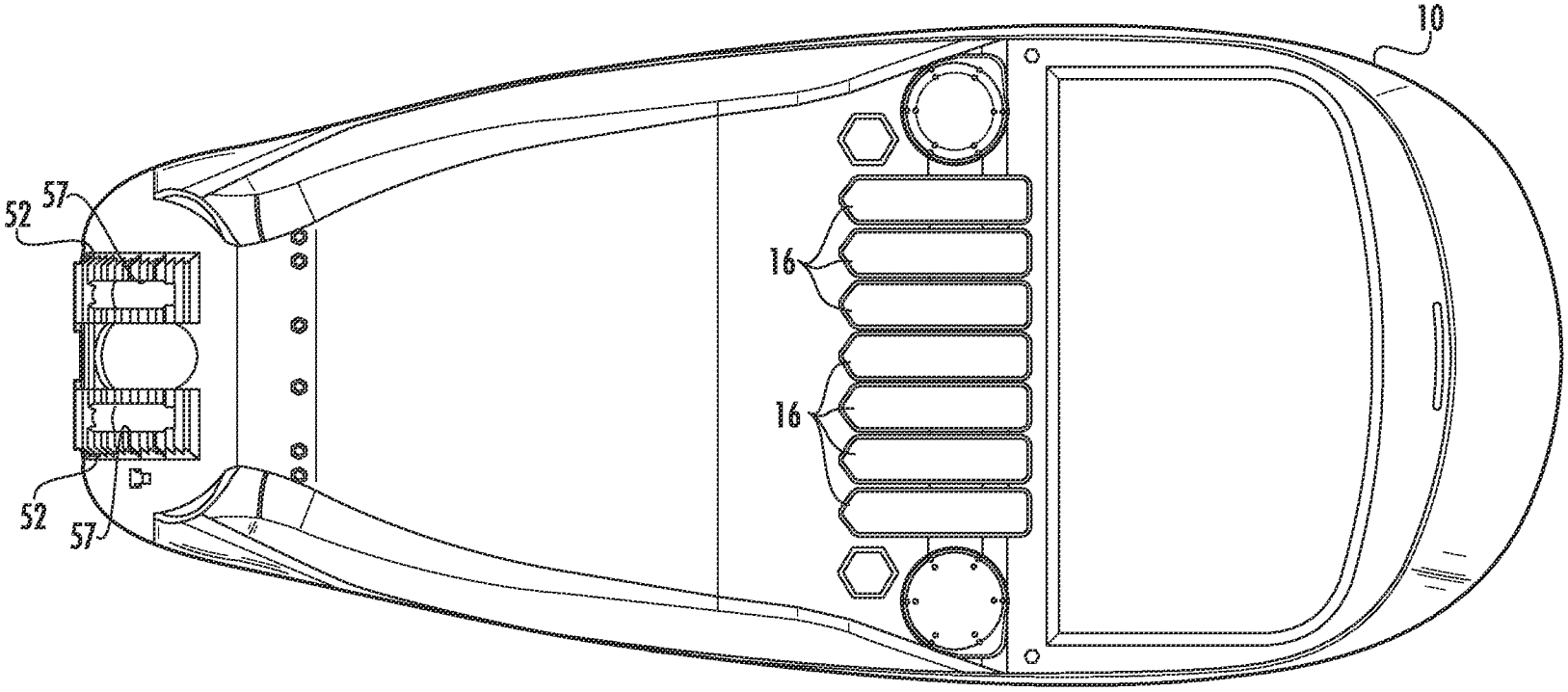
FIG. 9 is a view of the bottom housing portion of the luminaire of FIG. 1.
Figure 10:
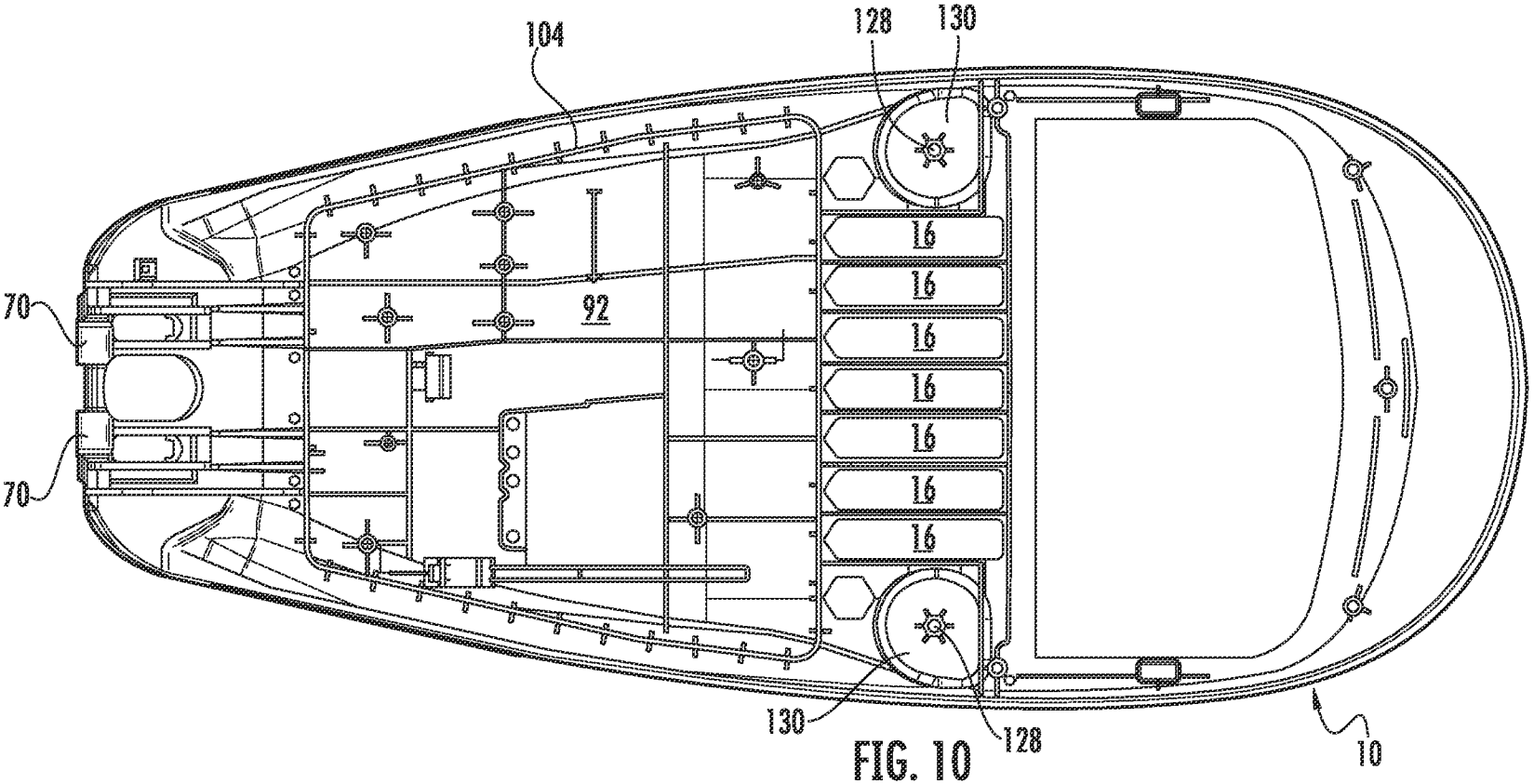
FIG. 10 is a view of the interior of the bottom housing portion of the luminaire of FIG. 1.
Figure 11:
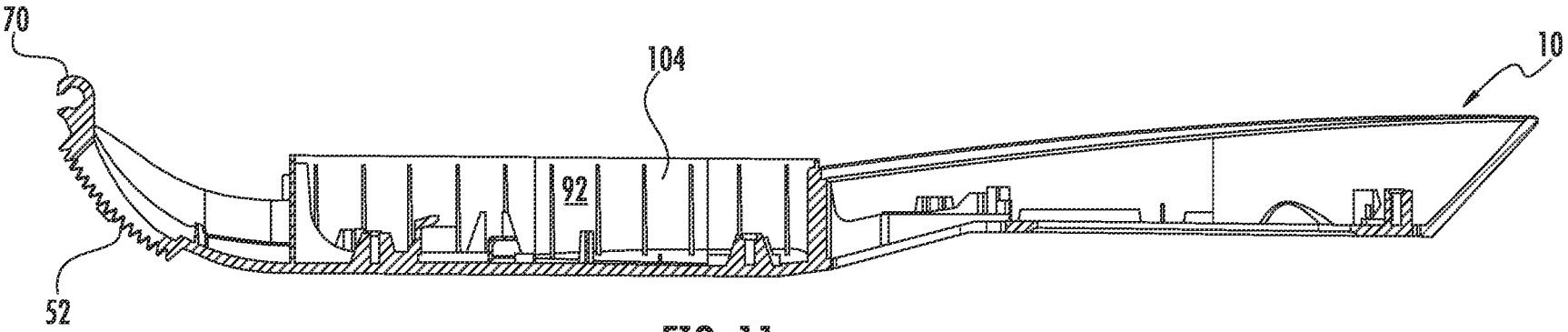
FIG. 11 is a section view of the bottom housing portion of the luminaire of FIG. 1 taken along a longitudinal centerline.

Because the arrangement of the convection openings 14 and 16, heat exchanger 36 and the vertical orientation of the LED board 24 adequately cools the LEDs 22, driver circuit 30 and waveguide 20, it is not necessary that the housing 4 be made of a material with a high thermal conductance, such as aluminum. As a result, the top housing portion 8 and the bottom housing portion 10 are made of thermoplastic, thermoset plastic or other similar polymeric material (hereinafter "polymeric material") and may be made by a suitable process such as injection molding, compression molding or the like. The use of a polymeric material for the housing 4 provides many advantages. Polymeric material is less expensive to manufacture and lighter than aluminum and has a lower environmental impact than aluminum. Also, polymeric material may be colored at the source such that the housing 4 does not have to be painted in a separate manufacturing process. The polymeric material housing 4 also allows features of the luminaire 2 to be formed as one-piece with the housing as will hereinafter be described. The use of a polymeric material and associated manufacturing processes allows features to be formed unitarily with the housing that is not possible when the housing is made of materials such as aluminum In general, the luminaire 2 may be installed and/or maintained as follows. The customer may receive a luminaire 2 as a complete unit. The luminaire 2 may be installed on a stanchion or other support structure 3 using bracket 5. The bracket 5 may be secured to the stanchion using bolts 15. The housing 4 is opened as shown in FIG. 5 to allow access to secure one or more bolts 50. The toothed structure 52 on the back of the bottom housing portion 10 engages a mating toothed structure 53 on the bracket 5 or other support structure. The engagement of the toothed structures 52, 53 is selected to set the housing 4 at the desired angle relative to horizontal. After the luminaire 2 is properly oriented, the bolts 50 are inserted through apertures 57 in the bottom housing portion 10 and threadably engage threaded holes 55 on the bracket 5 or other support structure to affix the luminaire 2 to the stanchion, pole or other support structure 3. Other mounting arrangements may be used to attach the luminaire 2 to a support structure.

Figure 16:
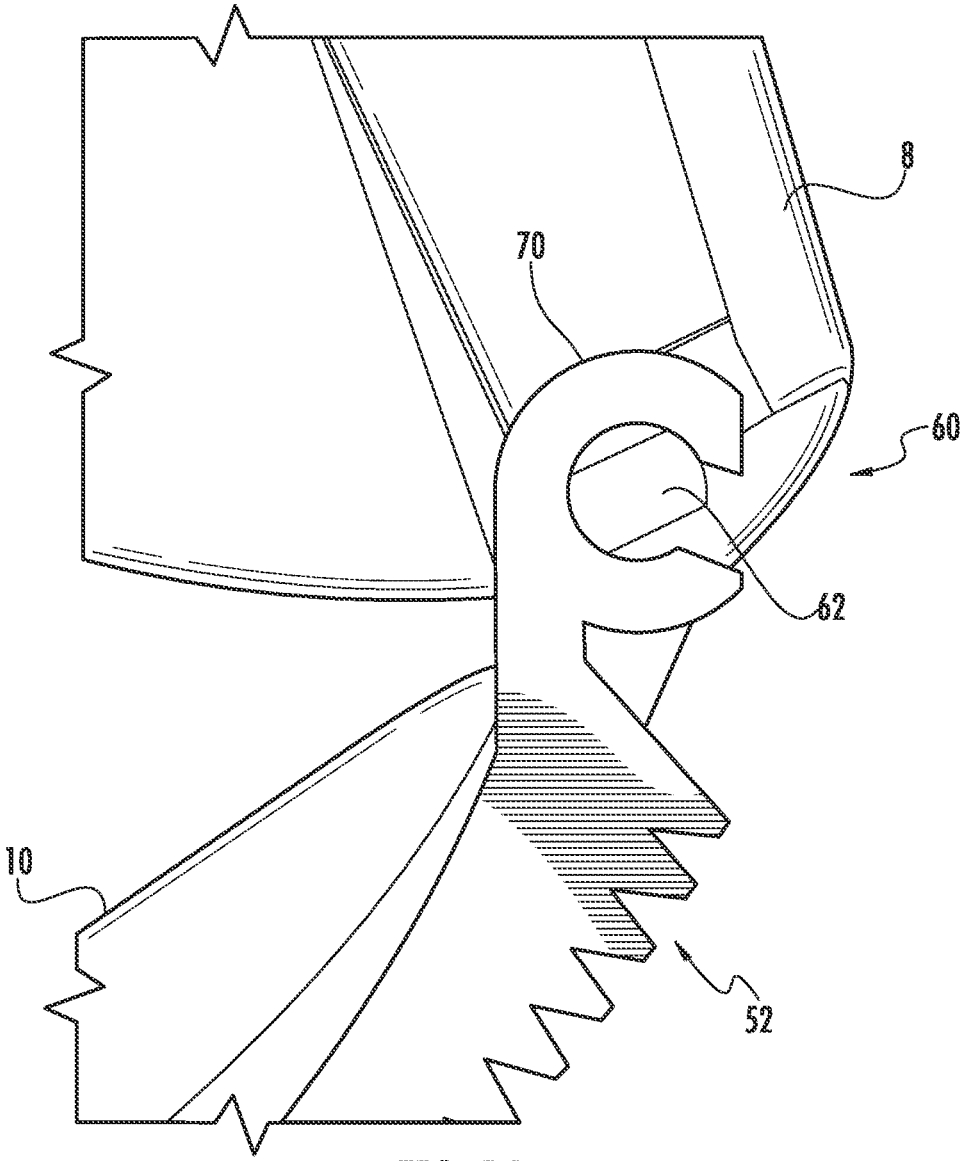
Figure 17:
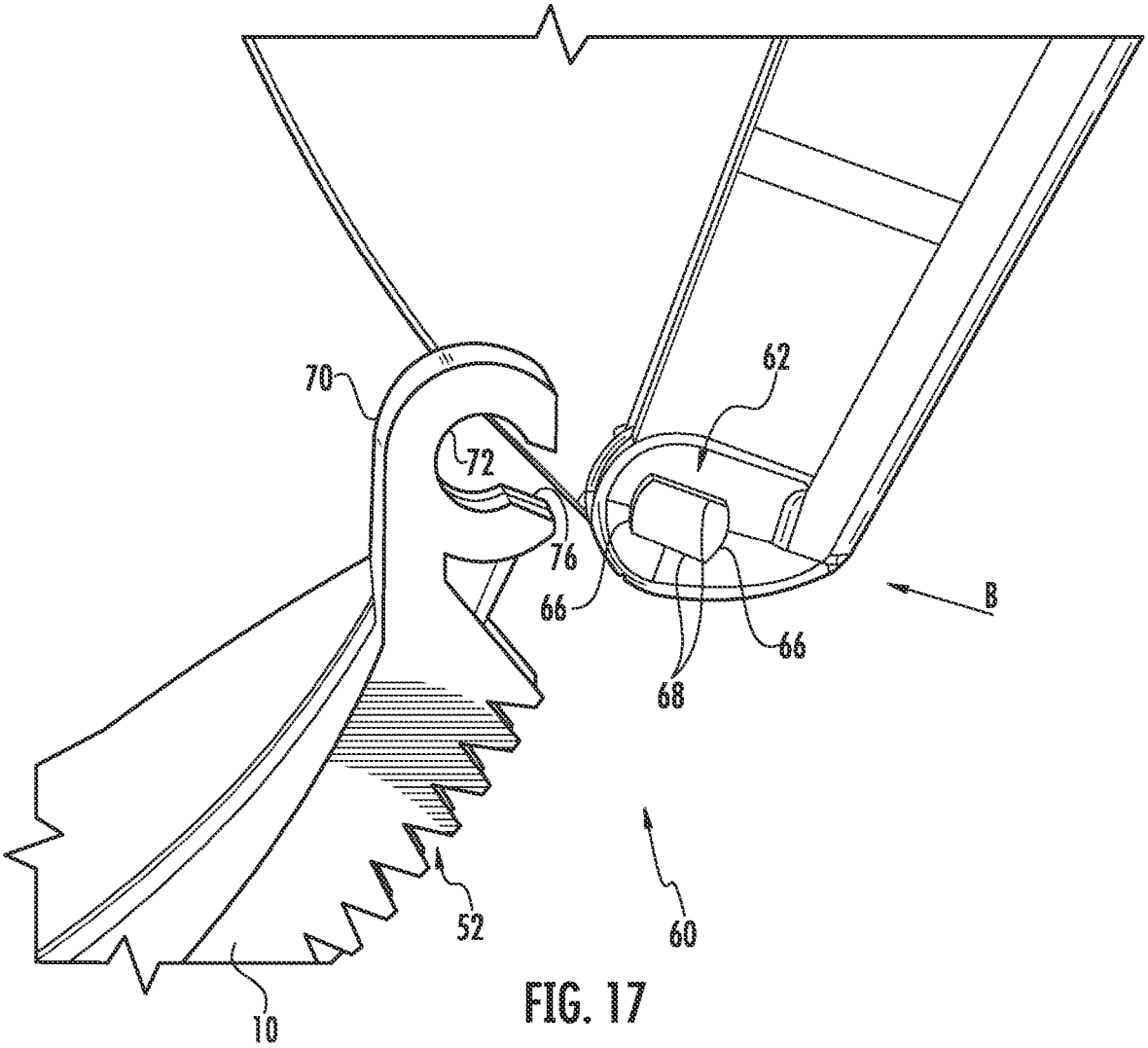

Referring to FIGS. 7 through 19, an integrated hinge structure 60 is provided to pivotably connect the top housing portion 8 to the bottom housing portion 10. The hinge structure 60 does not require separate fasteners or other parts that are not formed as one-piece with the top and bottom housing portions 8 and 10. In the illustrated embodiment, the hinge structure 60 comprises a plurality of spaced pintles 62 formed on the back edge of the top housing portion 8. The ends of the pintles 62 are defined by spacers 64 that have larger diameter than the pintles 62. Referring more specifically to FIG. 17, each pintle 62 has an external surface that is formed by a pair of curved surfaces 66 that define the rotational support surface of the pintles 62 and that are centered on the axis of rotation of the hinge structure 60. The rotational support surfaces 64 are connected by parallel flat surfaces 68 such that the pintle 62 has a generally oblong shape. The pintles 62 and spacers 64 are formed integrally, and as one-piece, with the top housing portion 8 to form a unitary structure.

Figure 12:
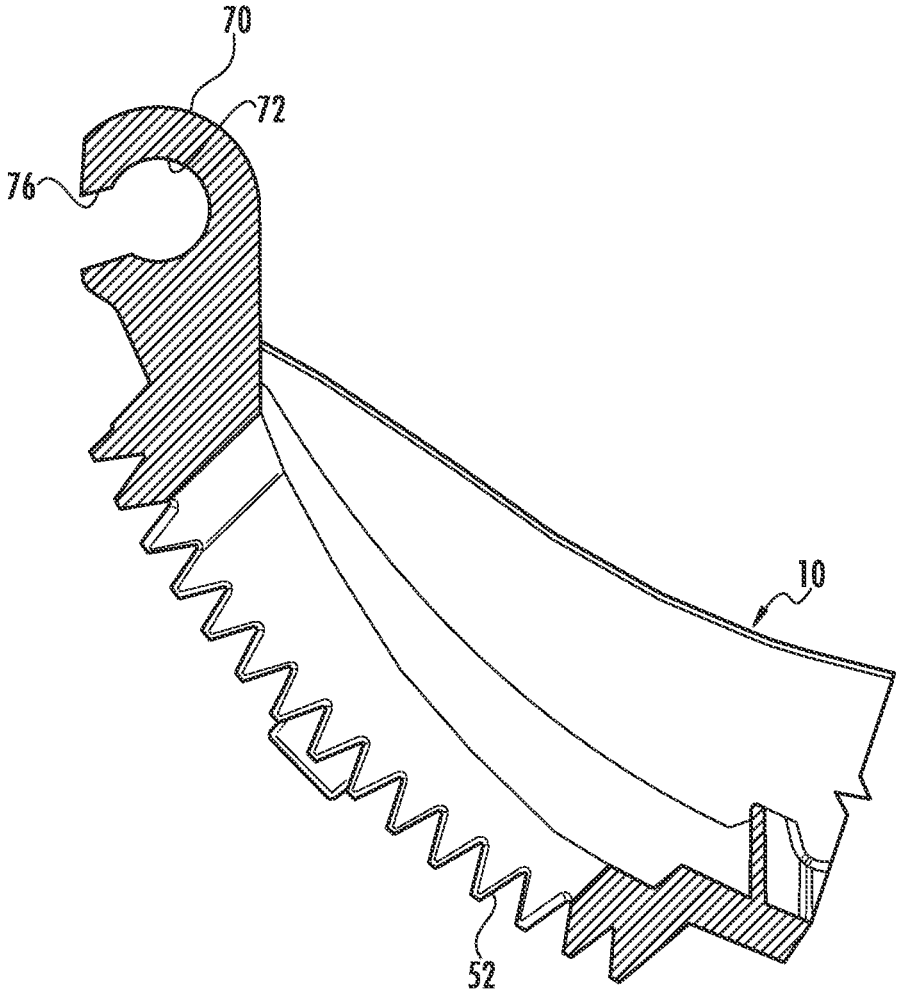
FIG. 12 is a detailed section view of the bottom housing portion of the luminaire of FIG. 1.
Figure 13:
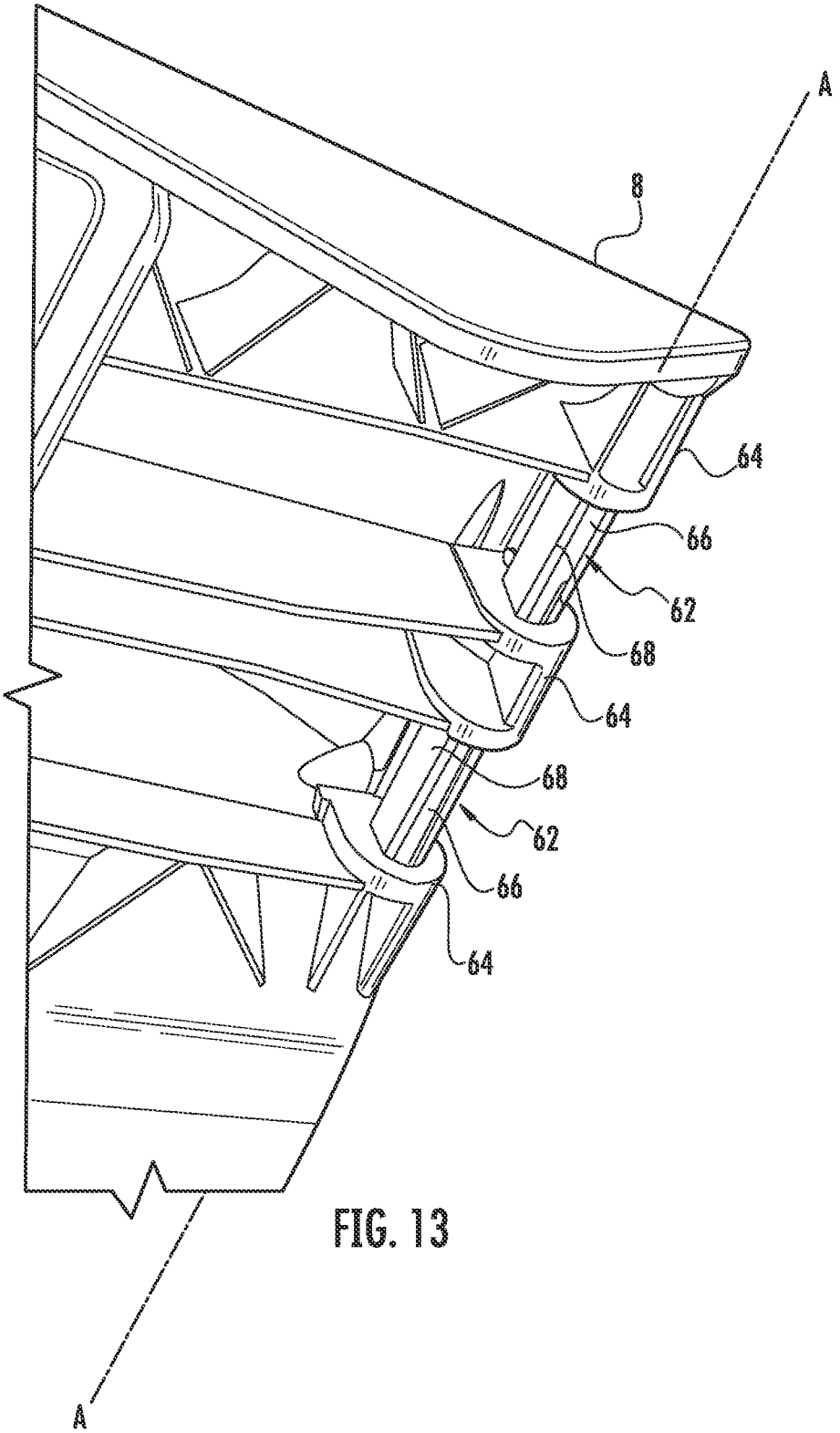
FIG. 13 is a detailed perspective view showing a portion of the hinge assembly of the luminaire of FIG. 1.
Figure 14:
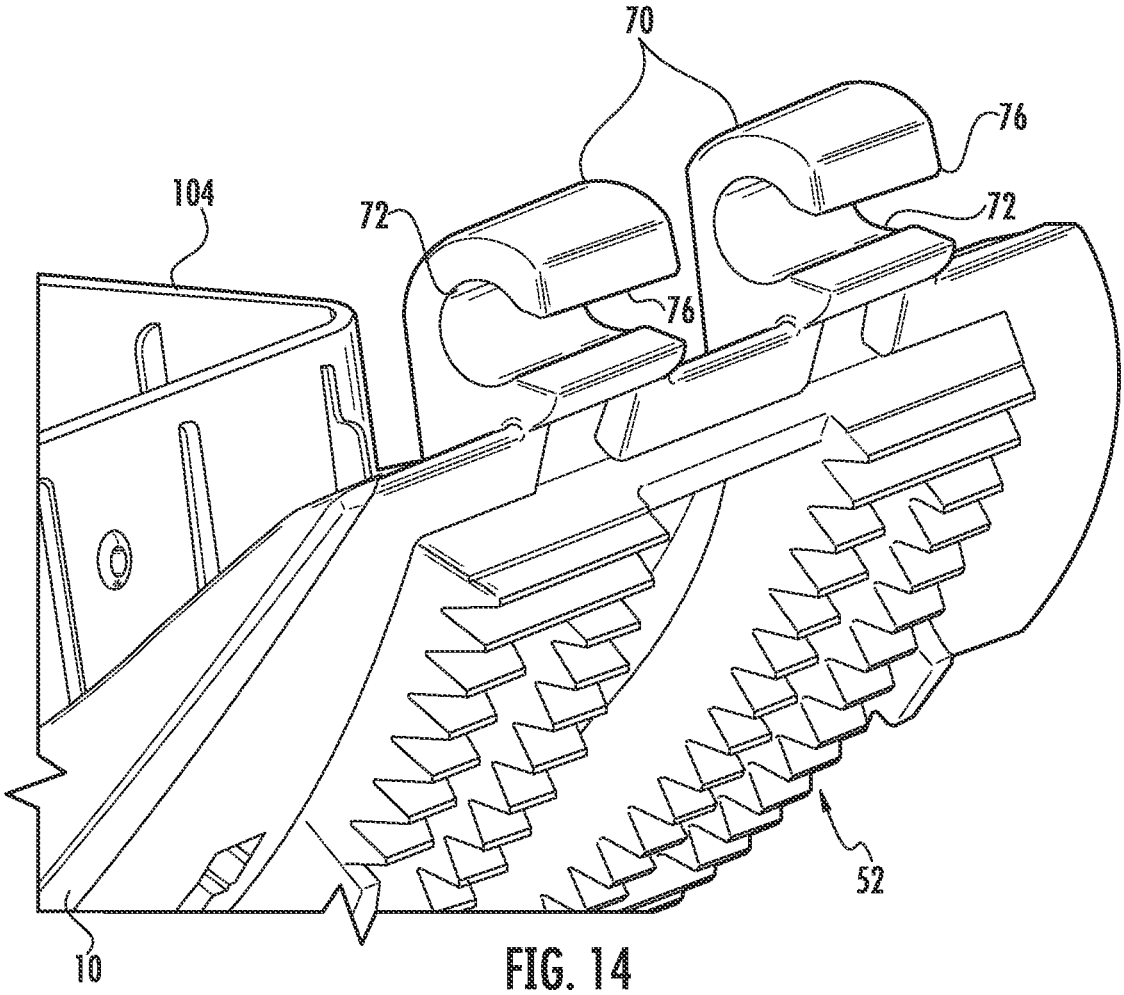
FIG. 14 is a detailed perspective view showing another portion of the hinge assembly of the luminaire of FIG. 1.

The hinge structure 60 further comprises a plurality of spaced knuckles 70 formed on and extending from the back edge of the bottom housing portion 10. The knuckles 70 are positioned such that one of the knuckles 70 is aligned with one of the pintles 62 when the top housing portion 8 is positioned on the bottom housing portion 10. Referring more specifically to FIG. 12, each knuckle 70 defines a generally cylindrical sleeve 72 that is configured to receive an associated pintle 62 such that the pintle 62 is rotatably received in the knuckle 70. Specifically, the cylindrical sleeve 72 is dimensioned such that the diameter of the sleeve 72 is slightly larger than the effective diameter of the pintles 62. The effective diameter of the pintles 62 being the distance between rotational support surfaces 66. As a result, the rotational support surfaces 66 of the pintles 62 are rotatably supported by the cylindrical surface of the sleeve 72. The pintles 62 may rotate in the sleeves 72 about rotational axis A-A (FIG. 13). The top housing portion 8 may be rotated relative to the bottom housing portion 10 between open and closed positions by rotating the pintles 62 in the knuckles 70. The knuckles 70 are formed integrally, and as one-piece, with the bottom housing portion 10 to form a unitary structure.

Figure 15:
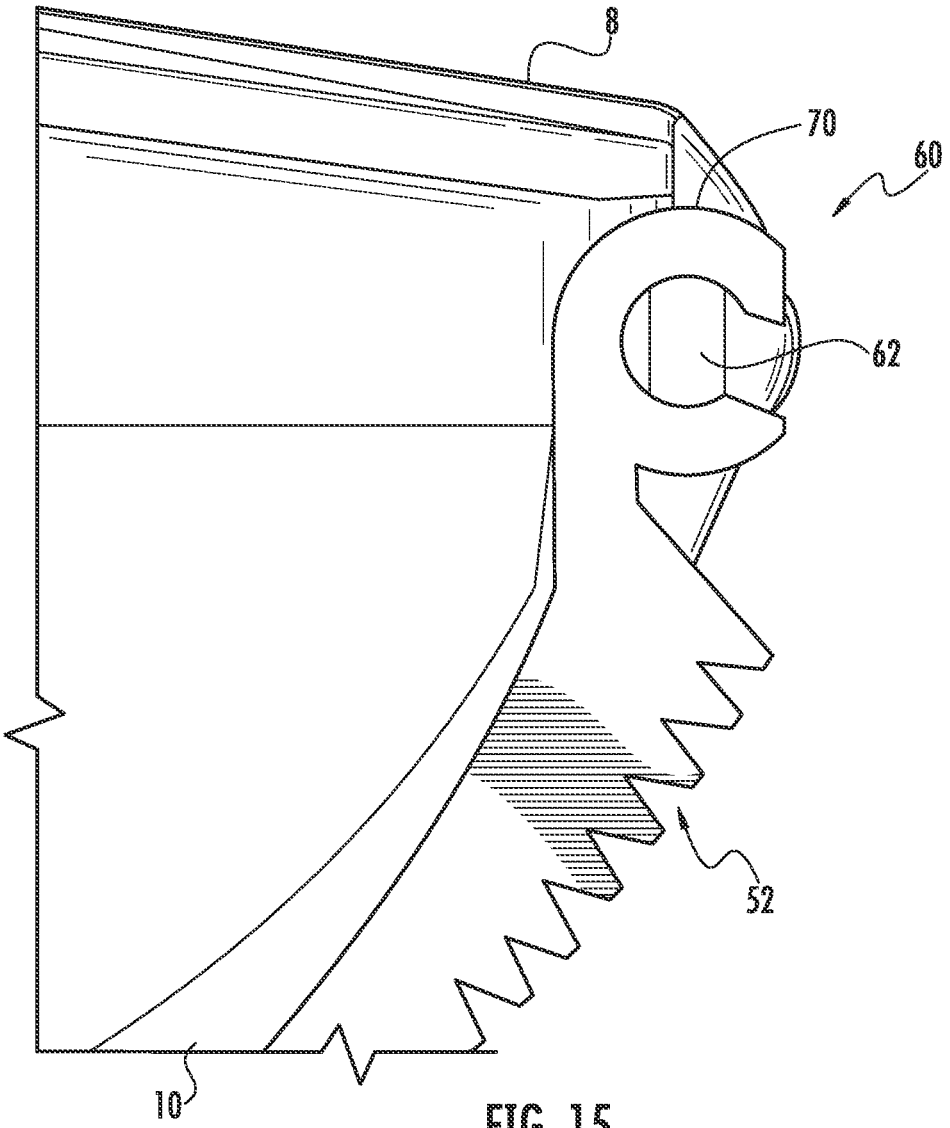
FIGS. 15 through 19 are detailed partial side views showing the operation of the hinge assembly of the luminaire of FIG. 1.
Figure 18:
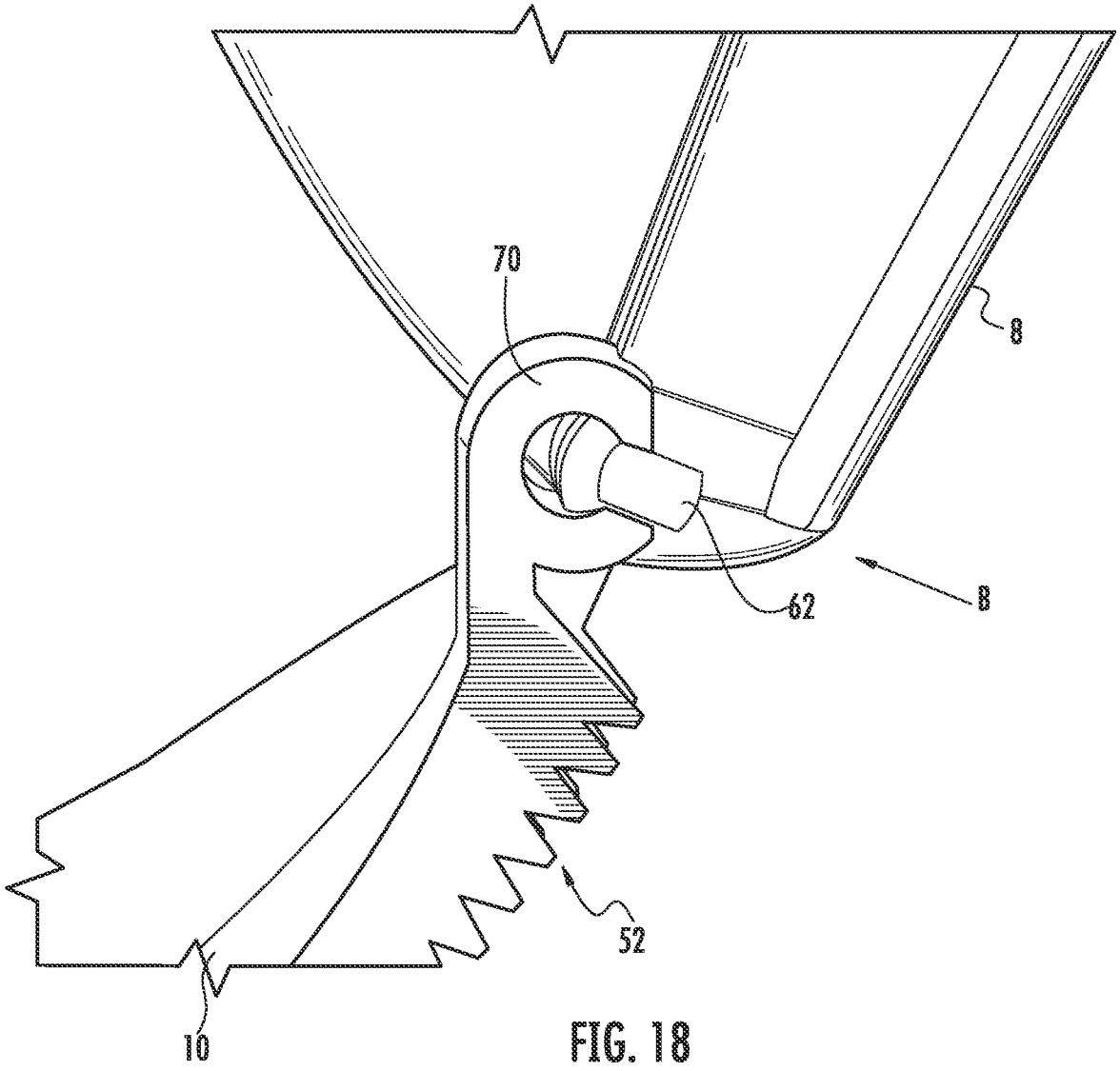
Figure 19:
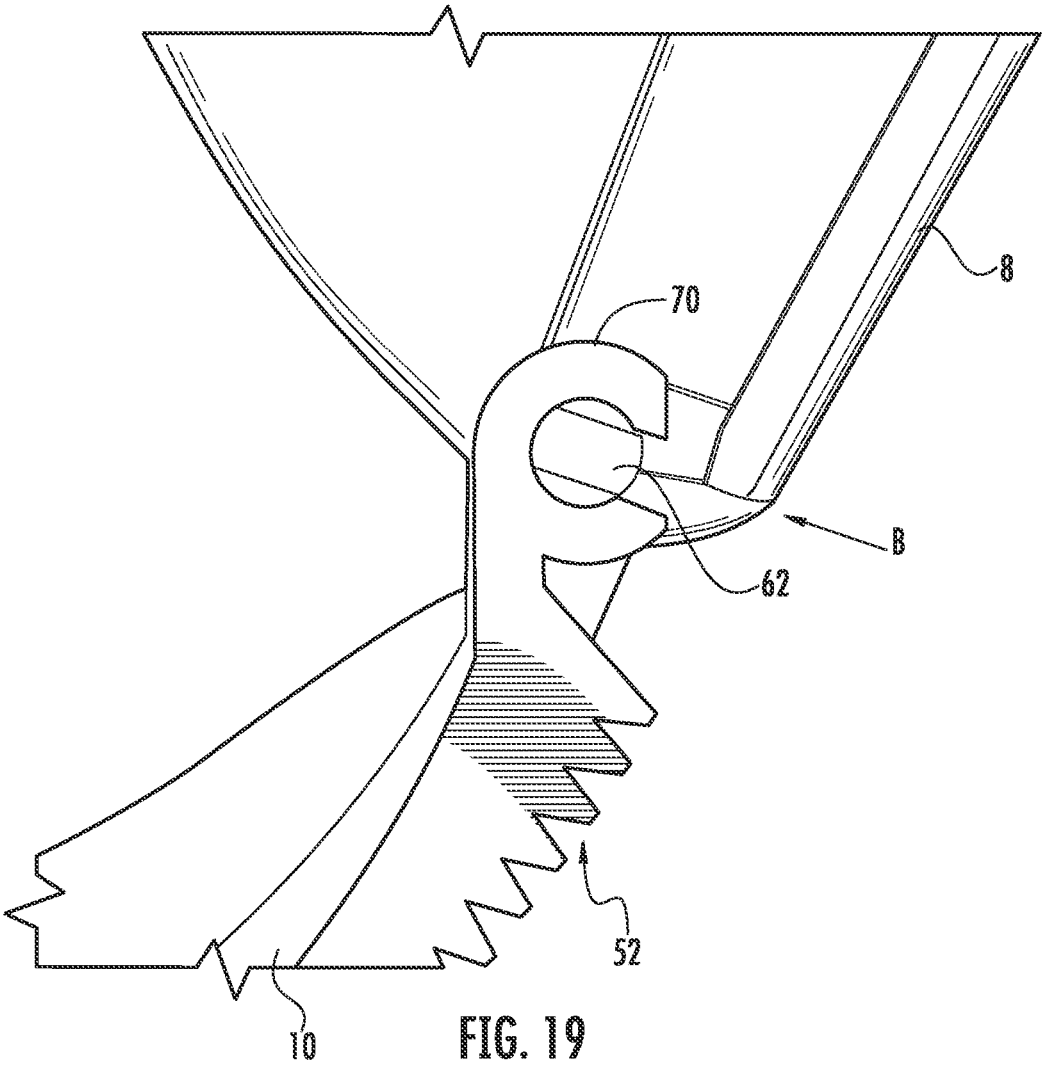
Figure 20:
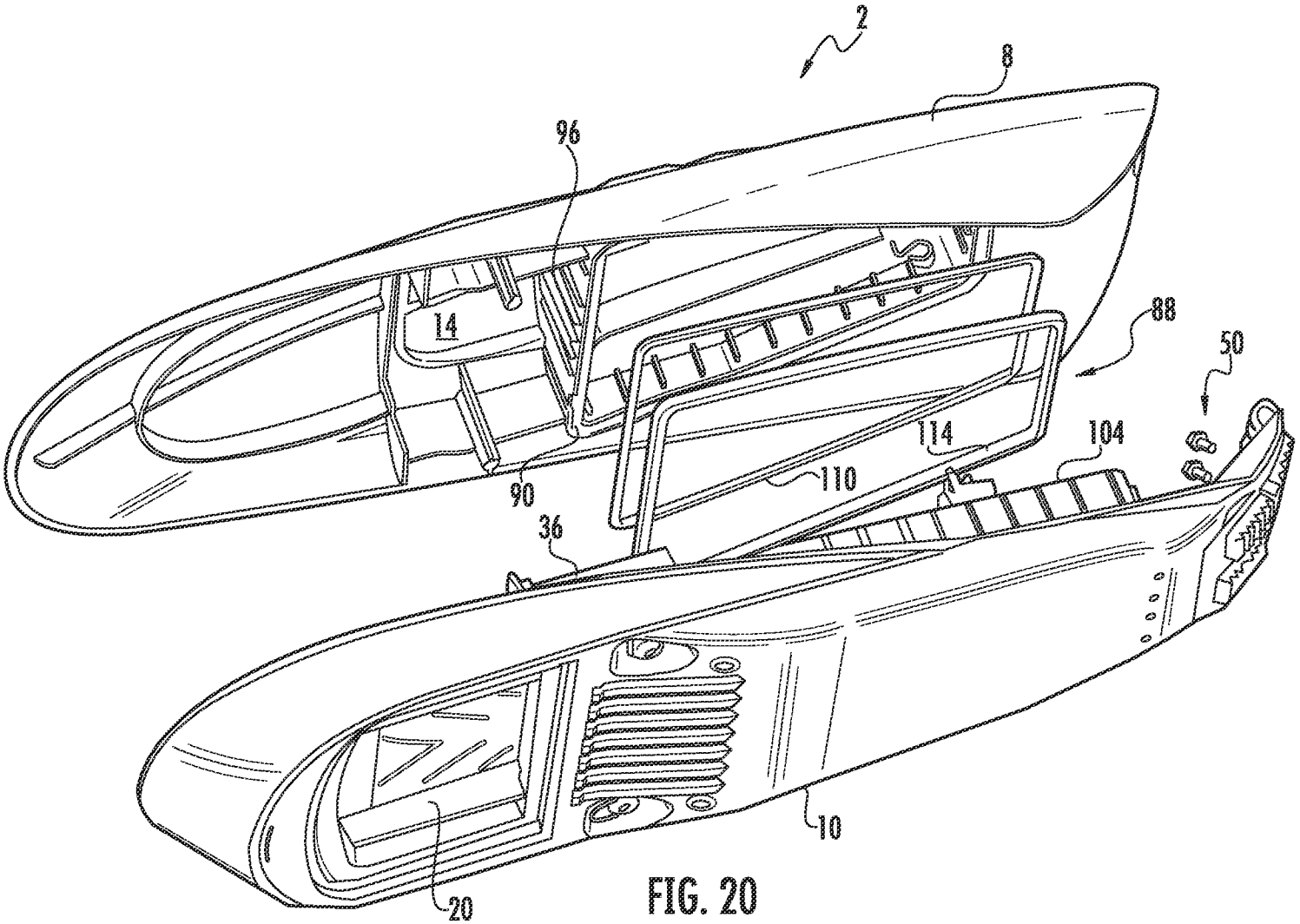
FIG. 20 is an exploded perspective view showing an embodiment of the sealing assembly of the luminaire of FIG. 1.
Figure 21:
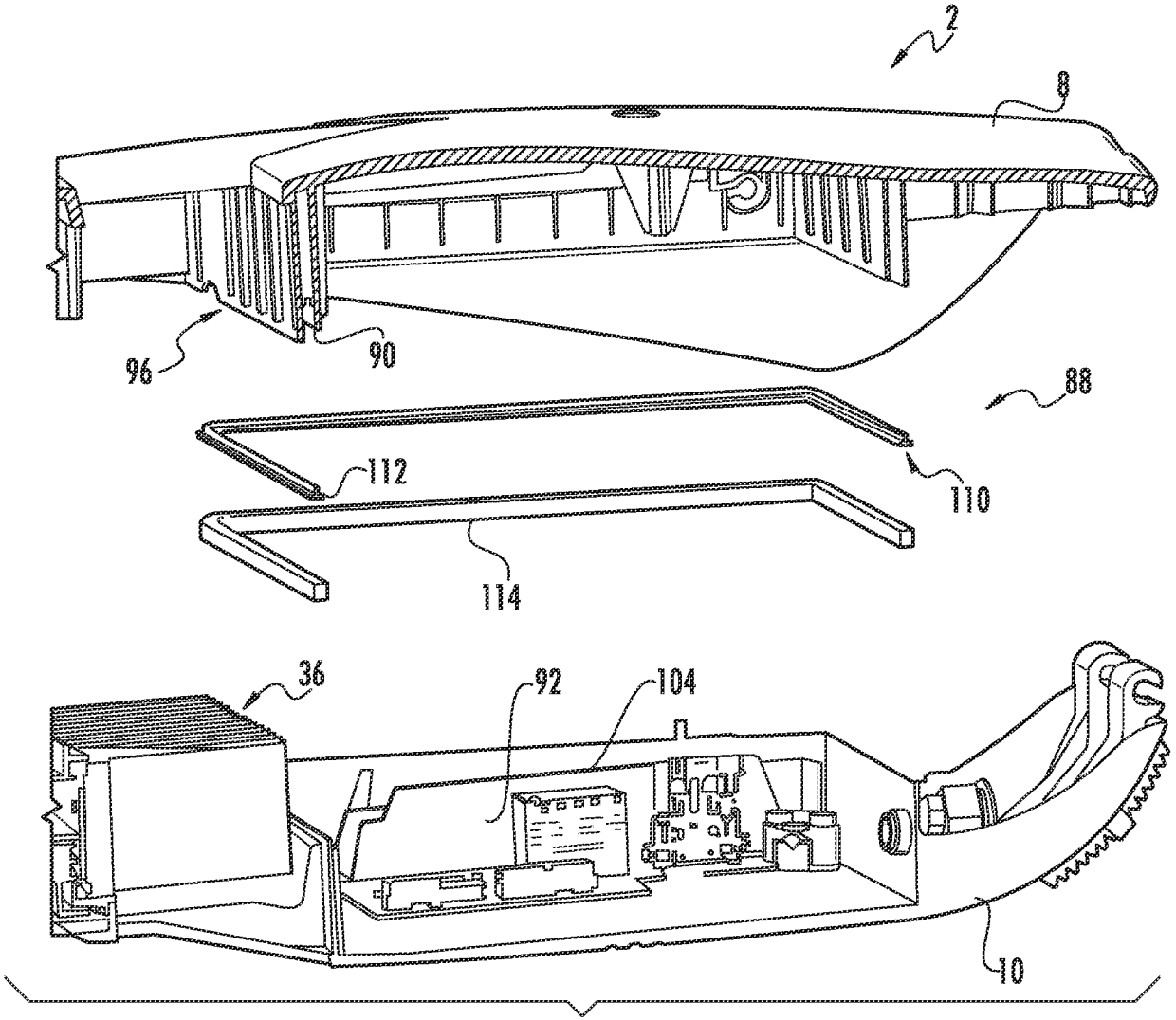
FIG. 21 is an exploded perspective section view showing an embodiment of the sealing assembly of the luminaire of FIG. 1.
Figure 22:
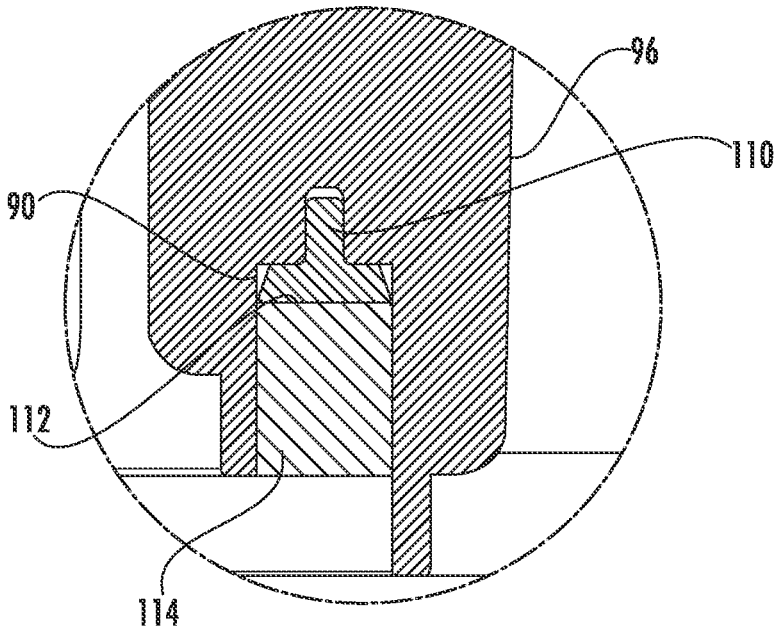
FIG. 22 is a section view showing an embodiment of the sealing assembly of the luminaire of FIG. 1.

While each knuckle 70 comprises a generally cylindrical sleeve 72, an opening 76 interrupts the wall of the knuckle 70 and communicates with the sleeve 72 such that the interior of the knuckle 70 is in communication with the exterior of the knuckle 70. The opening 76 is dimensioned such that it has a width that is approximately equal to or slightly greater than the distance between the flat surfaces 68 of the pintles 62. The top housing portion 8 may be rotated relative to the bottom housing portion 10 such that the pintles 62 are aligned with the knuckles 70 as shown in FIGS. 17 through 19. In this position, one of the pintles 62 may be slid into or out of each one of the knuckles 70 through openings 76. In any other relative rotational position between the top housing portion 8 and the bottom housing portion 10, the pintles 62 cannot fit through openings 76 and the pintles 62 may not be removed from the knuckles 70 (FIGS. 15 and 16). To assemble the top housing portion 8 to the bottom housing portion 10, the pintles 62 are aligned with the openings 76 in the knuckles 70 such that the pintles 62 may be inserted into the knuckles 70, in the direction of arrow B, as shown in FIG. 17. The pintles are inserted into the knuckles 70 as shown in FIG. 18 until the pintles 62 are fully seated in the knuckles 70 as shown in FIG. 19. When the top housing portion 8 is rotated relative to the bottom housing portion 10, away from the insertion position, the pintles 62 cannot be removed from the knuckles 70 as is shown in FIGS. 15 and 16. In the assembled luminaire 2, the top housing portion 8 may be rotated from about 0 degrees to about 60 degrees relative to the bottom housing portion 10 during use and the top housing portion 8 may be removed at approximately 110 degrees relative to the bottom housing portion 10. Because the pintles 62 and knuckles 70 are molded as one piece with the polymeric top portion 8 and bottom housing portion 10, respectively, and the hinge structure 60 may be assembled by inserting the pintles 62 into the knuckles to through the openings 76, the hinge structure 60 may be assembled without the use of any separate components such as separate fasteners, pintle pins or the like. While the pintles 62 are shown on the top housing portion 8 and the knuckles 70 are shown on the bottom housing portion 10, these structures may be reversed in some embodiments where the pintles 62 are on the bottom housing portion 10 and the knuckles 70 are on the top housing portion 8.

To protect the internal components of the luminaire 2, it may be beneficial to provide a sealing structure 88 between the top housing portion 8 and bottom housing portion 10 that isolates the interior components, including electrical components, from the exterior environment to prevent the introduction of liquids, debris and the like into the interior of the luminaire. The use of molded polymeric material components for the top housing portion 8 and the bottom housing portion 10 also provides for a sealing structure between the top housing portion 8 and the bottom housing portion 10 that may be assembled without using separate fasteners. Referring more particularly to FIGS. 5, 7, 8, 10, 11, 20, 21 and 22, a channel 90 is formed in the top housing portion 8 that extends about the periphery of at least one compartment 92 that is formed in the housing 4 between the top housing portion 8 and the bottom housing portion 10. The compartment 92 may house components that are sensitive to moisture such as electrical components such as wiring, electrical connectors 89, power supply 32, sensors 7, other electronics 91, or the like. The compartment 92 is defined on the top housing portion 8 by a wall 96 that extends from the interior of the top housing portion 8 toward the bottom housing portion 10. The wall 96 comprises channel 90 that extends about the distal edge of the wall 96 and opens downwardly towards the bottom housing portion 10. The wall 96 and channel 90 are formed integrally, and as one-piece, with the top housing portion 8 to form a unitary structure. In the illustrated embodiment, the wall 96 has a generally rectangular shape to define a generally rectangular compartment 92 although the wall 96 and the compartment 92 may have any shape and more than one compartment may be provided in the luminaire 2. A sealing member 104 extends from the bottom housing portion 10 toward the top housing portion 8. The sealing member 104 is positioned such that the end of the sealing member 104 extends into the chamber 90 when the housing is closed. The sealing member 104 may be formed as a wall that extends from the interior of the bottom housing portion 10 toward the top housing portion 8 and forms part of the wall of compartment 92. The sealing member 104 is formed integrally, and as one-piece, with the bottom housing portion 10 to form a unitary structure.

A frame 110 may be positioned in the channel 90 that defines a flat, continuous sealing surface 112 for receiving a deformable gasket 114. In one embodiment, the frame 110 may be secured in the channel 90 using a press fit. However, other securement mechanisms may be used such as adhesive, deformable tangs or the like. The frame 110 may be used to prevent external defects on the housing 2 that may occur in the molding process of the top housing portion 8 if a flat sealing surface is molded directly in the top housing portion 8. However, in some embodiments, the frame 110 may not be required where the sealing surface 112 may be directly formed as part of the top housing portion 8 without affecting the external appearance of the top housing portion 8. Gasket 114 is disposed on the sealing surface 112. The gasket 114 may comprise a resiliently deformable material such as foam, rubber, synthetic rubber, elastomer or the like. In one embodiment, the gasket 114 comprises a form-in-place soft foam. The form-in-place foam is applied to the sealing surface 112 as a liquid which then cures to make the deformable foam gasket. In other embodiments, the gasket 114 may be a separate component that is secured in place on the sealing surface 112 such as by adhesive, press fit or the like.

When the housing 2 is closed, the distal end of sealing member 104 is inserted into the channel 90 such that it engages and deforms the gasket 114 and forms a liquid-tight seal between the housing portions 8 and 10. The gasket 114 completely surrounds the interior compartment 92 to isolate the compartment 92 from the external environment and protect the internal components of the luminaire 2. The gasket 114 may be formed of a single member or a plurality of members that together create the liquid-tight seal. While the gasket 114 is shown as being formed on the top housing portion 8 and the sealing member 104 is shown as being formed on the bottom housing portion 10, these structures may be reversed in some embodiments where the gasket 114 is formed on the bottom housing portion 10 and the sealing member 104 is formed on the top housing portion 8.

Figure 23:
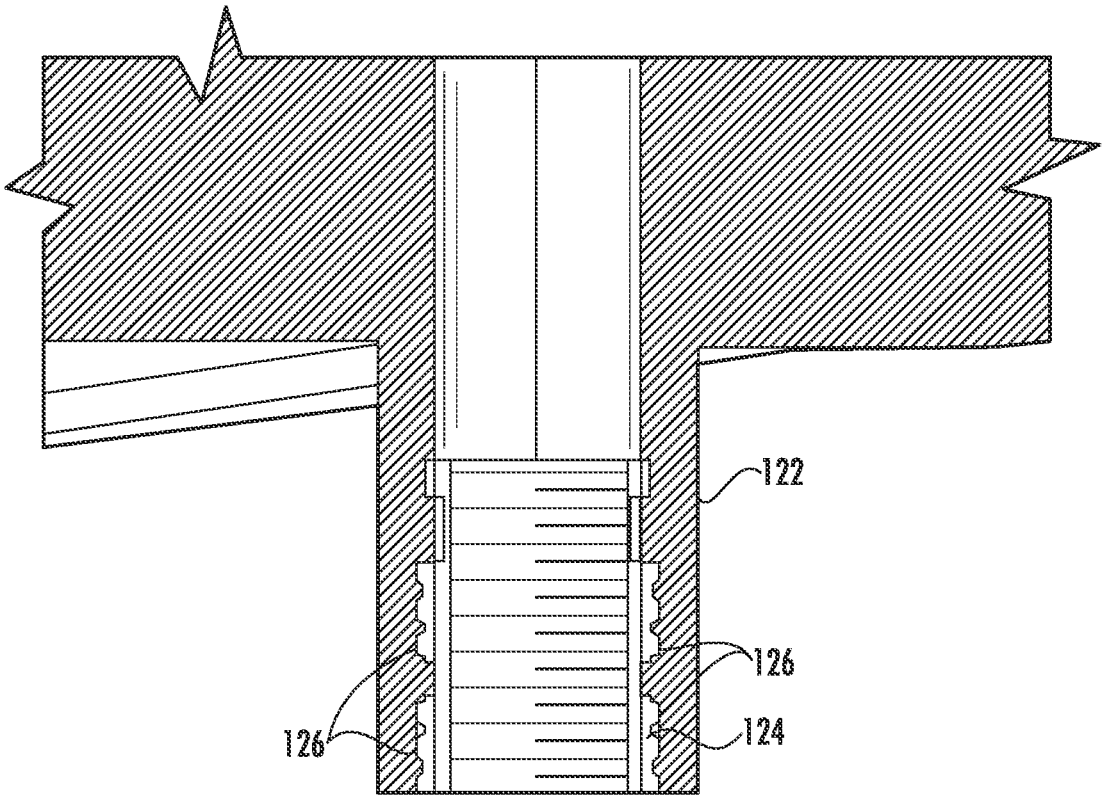
FIG. 23 is a detailed section view showing an embodiment of a locking feature of the luminaire of FIG. 1.
Figure 24:
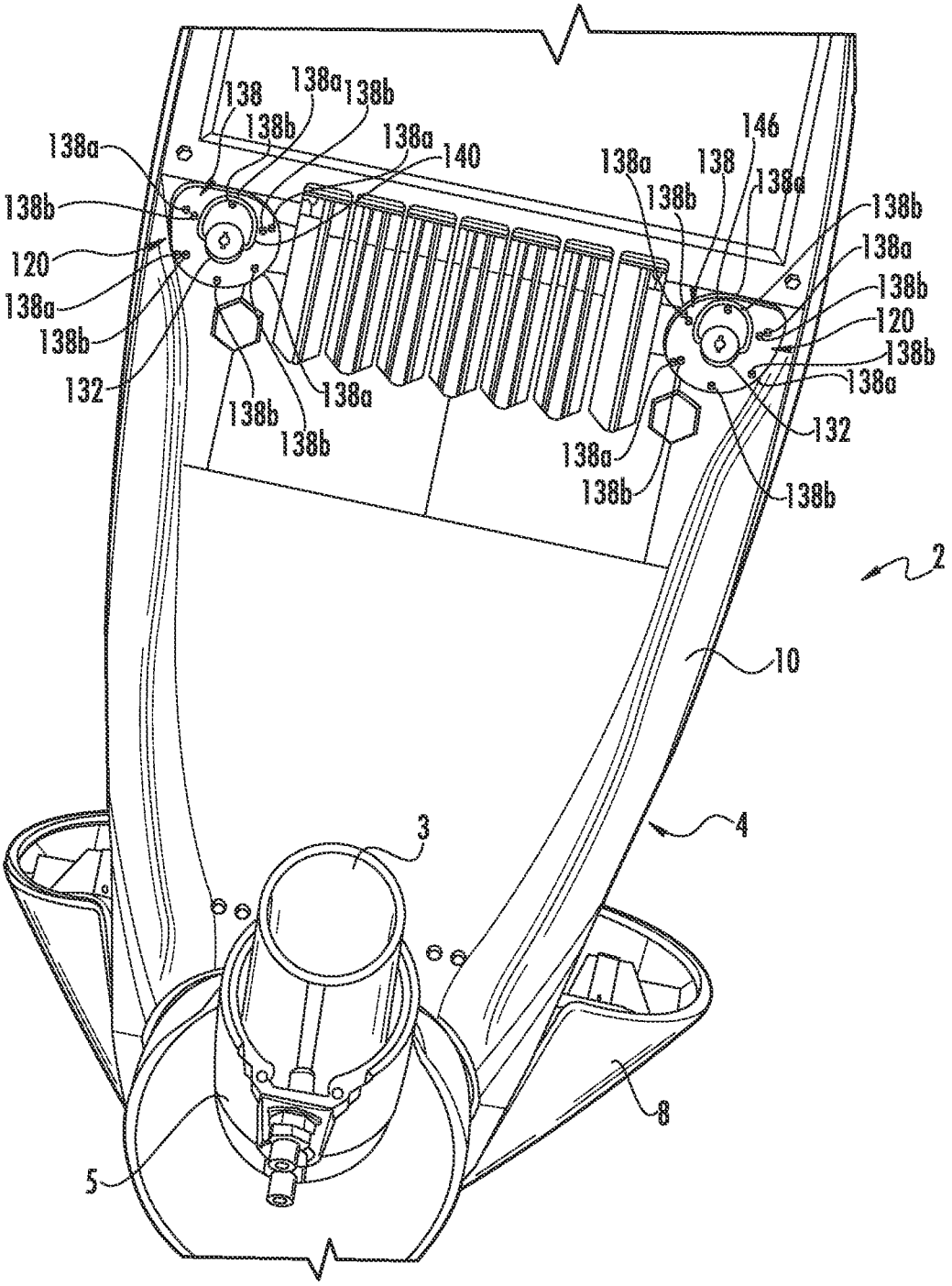
FIG. 24 is a detailed bottom view showing an embodiment of a locking feature of the luminaire of FIG. 1.
Figure 25:
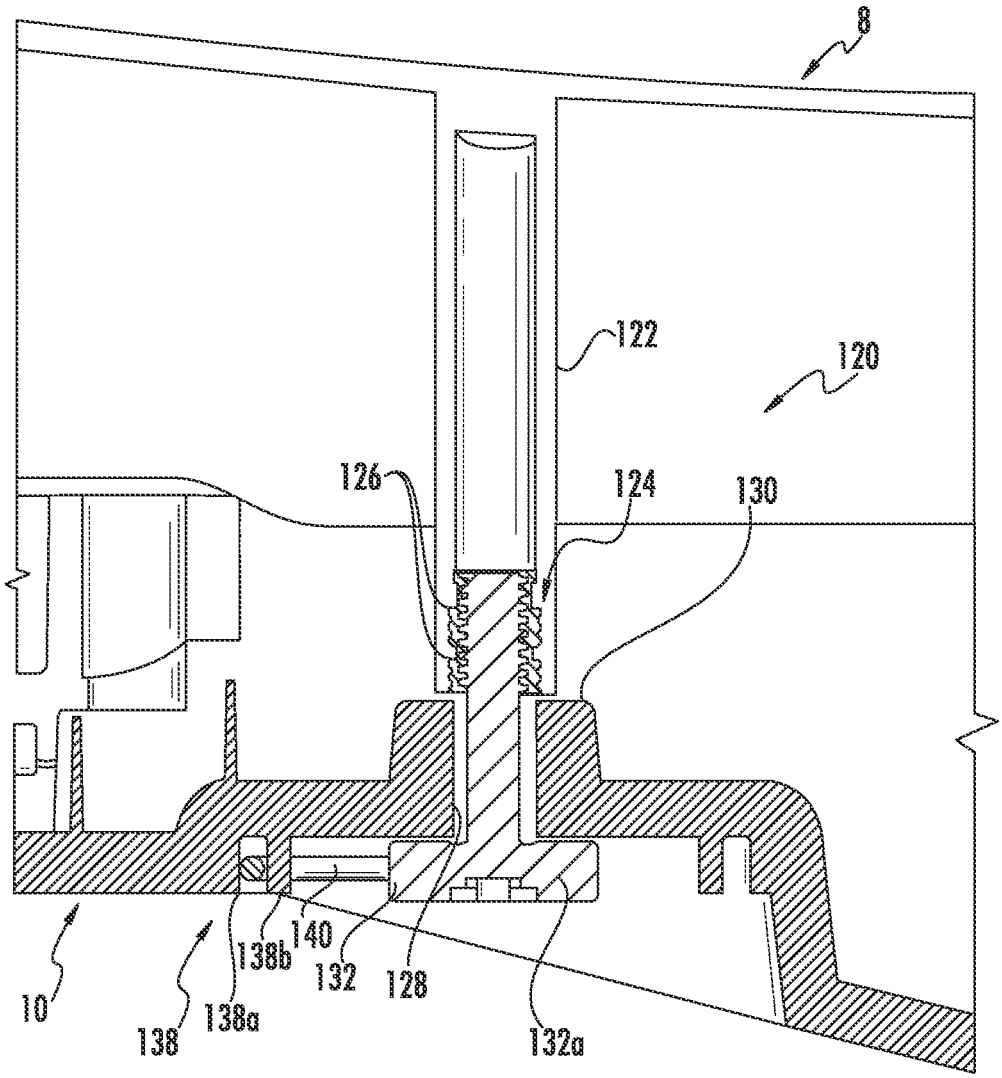
FIG. 25 is a detailed section view showing an embodiment of a locking feature of the luminaire of FIG. 1.

Because the housing 4 is made of polymeric material, locking features 120 may be made integrally and as one-piece with the housing 4 to form a unitary structure. The locking features 120 secure the housing portions 8 and 10 together in the closed position. Referring to FIGS. 23, 24 and 25, the each locking feature 120 comprises a tubular member 122 (see also, FIGS. 7 and 8) that extend from the top housing portion 8 toward the bottom housing portion 10 and supports a mating connector. The mating connector may comprise a threaded fitting 124 that is secured in each of the tubular members 122 adjacent the distal ends thereof. The threaded fittings 124 may comprise metal fittings, such as brass, having internal screwthreads and having an external engagement structure 126, such as teeth or projections, formed on the exterior thereof. Each fitting 124 may be force fit into one of the tubular members 122 such that the engagement structure 126 engages and deforms the interior wall of the tubular member 122 and secures the fitting 124 in place. Other mechanisms may be used to secure the fitting 124 to the housing portion 8. The bottom housing portion 10 defines an aperture or through hole 128 and a surface 130 for engaging the end of the tubular members 122. A fastener 132, such as a threaded screw, is inserted through the aperture 128 and is threaded into engagement with the fitting 124 to tighten the top housing portion 8 against the bottom housing portion 10. When the screw 132 is tightly engaged, the end of tubular member 122 is pressed against surface 130. When the screws 132 are tightened the, sealing member 104 is also contacts and deforms the gasket 114 as previously explained.

The integrally formed locking feature 120 comprises a plurality of spaced pairs of projections 138 extending from the bottom housing portion 10 and spaced about the periphery of the aperture 128. Each pair of projections 138 includes a first outer projection 138*a* that is disposed relatively farther from aperture 128 than a second inner projection 138*b* along a radial line. The screw 132 includes a locking member 140 that pivots relative to the head 132*a* of the screw 132 such that the locking member 140 may be disposed substantially parallel to the exterior surface of the bottom housing portion 10. In one embodiment, the locking member 140 comprises a D-ring although the shape of the locking member 140 may vary. The outer projection 138*a* and the inner projection 138*b* are spaced from one another such that a portion of the locking member 140 may be snugly received between the inner projection 138*b* and the outer projection 138*a*. With the locking member 140 trapped between the inner projection 138*b* and the outer projection 138*a* the screw 132 is prevented from being inadvertently unscrewed or loosened such as by vibration of the luminaire.

While the fittings 124 are shown as being formed on the top housing portion 8 and the screw 132 is shown as engaging an aperture in the bottom housing portion 10, these structures may be reversed in some embodiments where the fittings 124 are formed on the bottom housing portion 10 and the screw 132 engages an aperture in the top housing portion 8.

The features formed as one-piece with the housing portions 8 and 10 as described herein are arranged such that in a two-part mold the features are arranged parallel to the direction of travel of the mold parts relative to one another to facilitate manufacture of the housing. For example, the convection openings 14 and 16, wall 96, sealing member 104, tubular members 122 and projections 138 extend generally parallel to one another and parallel to the direction of travel of the mold parts during the manufacturing process.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise. It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

Unless otherwise expressly stated, comparative, quantitative terms such as "less" and "greater", are intended to encompass the concept of equality. As an example, "less" can mean not only "less" in the strictest mathematical sense, but also, "less than or equal to."

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Components of the various embodiments of the present invention discussed above may be combined to provide additional embodiments. Thus, it will be appreciated that while a component or element may be discussed with reference to one embodiment by way of example above, that component or element may be added to any of the other embodiments.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A luminaire comprising:

a housing formed by a first housing portion formed of a polymeric material and a second housing portion formed of a polymeric material;

a light-emitting diode (LED) light source in the housing;

a hinge pivotably connecting the first housing portion to the second housing portion, the hinge comprising:

a plurality of pintles with ends defined by spacers having a larger diameter than the plurality of pintles, wherein the plurality of pintles and the spacers are formed as one-piece with the first housing portion; and a plurality of knuckles formed as one-piece with the second housing portion, wherein each of the plurality of pintles is rotatably received in one of the plurality of knuckles; and a toothed structure formed as one-piece with the plurality of pintles or the plurality of knuckles and configured to engage with a mating toothed structure on a support structure to set a desired angle of the housing relative to the support structure.

2. The luminaire of claim 1 wherein the plurality of pintles are formed on a back edge of the first housing portion and the plurality of knuckles comprise a plurality of spaced knuckles formed on and extending from the toothed structure at a back edge of the second housing portion.

3. The luminaire of claim 2 wherein the toothed structure comprises a plurality of toothed structures, each aligned with a corresponding one of the plurality of spaced knuckles.

4. The luminaire of claim 1 wherein each of the plurality of pintles comprises an external surface that is formed by a pair of curved surfaces that define a rotational support surface, the pair of curved surfaces being connected by flat surfaces.

5. The luminaire of claim 4 wherein each of the plurality of knuckles comprises a sleeve that rotatably receives a corresponding pintle and an opening in the sleeve that communicates an interior of the knuckle with an exterior of the knuckle.

6. The luminaire of claim 5 wherein the opening of each of the plurality of knuckles is dimensioned such that it has a width that is approximately equal to or slightly greater than a distance between the flat surfaces of the plurality of pintles.

7. The luminaire of claim 5 wherein each of the plurality of pintles is inserted through the opening of a corresponding knuckle.

8. The luminaire of claim 1 wherein:

the first housing portion and the second housing portion define a compartment; and a sealing structure is formed between the first housing portion and the second housing portion to seal the compartment.

9. The luminaire of claim 8 wherein the sealing structure comprises a channel supported by and formed as one-piece with one of the first housing portion or the second housing portion, the channel extending about a periphery of the compartment.

10. The luminaire of claim 9 wherein the channel is formed at the distal end of a wall extending from the one of the first housing portion or the second housing portion.

11. The luminaire of claim 9 wherein the sealing structure comprises a deformable gasket in the channel.

12. The luminaire of claim 11 wherein the deformable gasket comprises a form-in-place soft foam.

13. The luminaire of claim 11 wherein the sealing structure comprises a sealing member extending from and formed as one-piece with the other one of the first housing portion or the second housing portion, the sealing member extending into the channel and engaging the deformable gasket.

14. The luminaire of claim 9 wherein the sealing structure comprises a frame supported in the channel, the frame defining a sealing surface.

15. The luminaire of claim 14 wherein the sealing structure comprises a deformable gasket supported by the sealing surface.

16. The luminaire of claim 15 wherein the deformable gasket comprises a form-in-place soft foam.

17. The luminaire of claim 1 further comprising a locking feature for securing the first housing portion to the second housing portion, the locking feature comprising a fastener engaging one of the first housing portion or the second housing portion threadably engageable with a mating connector supported by the other one of the first housing portion or the second housing portion, the one of the first housing portion or the second housing portion comprising at least one pair of spaced projections and the fastener comprising a locking member movable between a first position where the locking member is secured by the at least one pair of spaced projections and a second position where the locking member is not secured by the at least one pair of spaced projections.

18. A luminaire comprising:

a housing formed by a first housing portion formed of a plastic material and a second housing portion formed of a plastic material, the first housing portion and the second housing portion defining a compartment and wherein a sealing structure is formed between the first housing portion and the second housing portion to seal the compartment;

the sealing structure comprising a channel supported by and formed as one-piece with one of the first housing portion or the second housing portion, the channel extending about a periphery of the compartment and a frame supported in the channel, the frame defining a sealing surface wherein the sealing surface supports a deformable gasket;

a sealing member extending from and formed as one-piece with the other one of the first housing portion or the second housing portion, the sealing member extending into the channel and engaging the deformable gasket;

an optical waveguide disposed in an opening in the second housing portion;

a plurality of light emitting diodes (LEDs) disposed within the housing and outside the compartment, wherein the plurality of LEDs is configured to emit light into the optical waveguide;

a hinge pivotably connecting the first housing portion to the second housing portion, the hinge comprising:

a plurality of pintles formed as one-piece with the first housing portion; and a plurality of knuckles formed as one-piece with the second housing portion, wherein each of the plurality of pintles is rotatably received in one of the plurality of knuckles; and a toothed structure formed as one-piece with the plurality of pintles or the plurality of knuckles and configured to engage with a mating toothed structure on a support structure to set a desired angle of the housing relative to the support structure.

19. The luminaire of claim 18 wherein:

the deformable gasket comprises a form-in-place soft foam; and the frame is press fit in the channel.

* * * * *